US007546241B2

(12) United States Patent
Yamada et al.

(10) Patent No.: US 7,546,241 B2
(45) Date of Patent: Jun. 9, 2009

(54) SPEECH SYNTHESIS METHOD AND APPARATUS, AND DICTIONARY GENERATION METHOD AND APPARATUS

(75) Inventors: Masayuki Yamada, Kanagawa (JP); Yasuhiro Komori, Kanagawa (JP); Toshiaki Fukada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 881 days.

(21) Appl. No.: 10/449,072

(22) Filed: Jun. 2, 2003

(65) Prior Publication Data

US 2003/0229496 A1 Dec. 11, 2003

(30) Foreign Application Priority Data

Jun. 5, 2002 (JP) ..... 2002-164624
Jul. 17, 2002 (JP) ..... 2002-208340

(51) Int. Cl.
*G10L 13/08* (2006.01)

(52) U.S. Cl. ..... 704/260; 704/258; 704/262; 704/266; 704/268

(58) Field of Classification Search ..... 704/260, 704/258, 262, 266, 268
See application file for complete search history.

(56) References Cited

U.S. PATENT DOCUMENTS 5,278,943 A * 1/1994 Gasper et al. ..... 704/200
5,327,498 A * 7/1994 Hamon ..... 704/268
5,544,201 A 8/1996 Hoshino et al.
5,642,466 A * 6/1997 Narayan ..... 704/260
5,745,650 A 4/1998 Otsuka et al. ..... 395/2.69
5,745,651 A 4/1998 Otsuka et al. ..... 395/2.77
5,864,796 A 1/1999 Inoue et al.
6,144,939 A * 11/2000 Pearson et al. ..... 704/258
6,553,343 B1 * 4/2003 Kagoshima et al. ..... 704/262
6,760,703 B2 7/2004 Kagoshima et al. ..... 704/262
6,980,955 B2 12/2005 Okutani et al.
6,993,484 B1 1/2006 Yamada et al.
7,054,815 B2 5/2006 Yamada et al.

(Continued)

FOREIGN PATENT DOCUMENTS

EP 0 984 425 3/2000

(Continued)

OTHER PUBLICATIONS

Noe et al., "Noise Reduction for Noise Robust Feature Extraction for Distributed Speech Recognition," *Proceedings of the 2001 Eurospeech Conference*, vol. 1, Sep. 3, 2001, pp. 473-476.

(Continued)

*Primary Examiner*—Qi Han
(74) *Attorney, Agent, or Firm*—Fitzpatrick, Cella, Harper & Scinto

(57) ABSTRACT

In a speech synthesis process, micro-segments are cut from acquired waveform data and a window function. The obtained micro-segments are re-arranged to implement a desired prosody, and superposed data is generated by superposing the re-arranged micro-segments, so as to obtain synthetic speech waveform data. A spectrum correction filter is formed based on the acquired waveform data. At least one of the waveform data, micro-segments, and superposed data is corrected using the spectrum correction filter. In this way, "blur" of a speech spectrum due to the window function applied to obtain micro-segments is reduced, and speech synthesis with high sound quality is realized.

4 Claims, 17 Drawing Sheets

U.S. PATENT DOCUMENTS

| | | | | |
|---|---|---|---|---|
| 7,184,958 | B2 | 2/2007 | Kagoshima et al. | 704/260 |
| 2001/0032078 | A1 | 10/2001 | Fukada | 704/258 |
| 2001/0032079 | A1 | 10/2001 | Okutani et al. | 704/258 |
| 2001/0037202 | A1 | 11/2001 | Yamada et al. | |
| 2001/0047259 | A1 | 11/2001 | Okutani et al. | 704/260 |
| 2003/0088418 | A1 | 5/2003 | Kagoshima et al. | 704/258 |
| 2004/0172251 | A1 | 9/2004 | Kagoshima et al. | 704/262 |

FOREIGN PATENT DOCUMENTS

| | | |
|---|---|---|
| JP | 61-172200 | 8/1986 |
| JP | 2-82710 | 3/1990 |
| JP | 2-247700 | 10/1990 |
| JP | 7-84993 | 3/1995 |
| JP | 7-152787 | 6/1995 |
| JP | 9-138697 | 5/1997 |
| JP | 9-230896 | 9/1997 |
| JP | 9-319394 | 12/1997 |
| JP | 11-95796 | 4/1999 |
| JP | 11-109992 | 4/1999 |
| JP | 11-109993 | 4/1999 |
| JP | 2000-75879 | 3/2000 |
| JP | 2001-117573 | 4/2001 |
| JP | 2001-282275 | 10/2001 |
| JP | 2001-282280 | 10/2001 |

OTHER PUBLICATIONS

Moulines et al., "Pitch-Synchronous Waveform Processing Techniques for Text-to-Speech Synthesis Using Diphones," *Speech Communication* (Elsevier Science Publishers, Amsterdam, Netherlands), vol. 9, Nos. 5/6, Dec. 1990, pp. 453-467.

Arai et al., "An Excitation Synchronous Pitch Waveform Extraction Method and Its Application to the VCV-Concatenation Synthesis of Japanese Spoken Words," *Spoken Language 1996*, ICSLP 96, Proceedings, Fourth International Conference, Oct. 1996, IEEE, U.S., vol. 3, Oct. 1996, pp. 1437-1440.

Japanese Office Action for 2002-164624 dated Jun. 15, 2007.

Office Action dated Mar. 16, 2007, issued in Japanese patent application No. 2002-164624, with English-language translation.

* cited by examiner

SPEECH SYNTHESIS METHOD AND APPARATUS, AND DICTIONARY GENERATION METHOD AND APPARATUS

FIELD OF THE INVENTION

The present invention relates to a speech synthesis apparatus and method for synthesizing speech.

BACKGROUND OF THE INVENTION

As a conventional speech synthesis method of generating desired synthetic speech, a method of generating desired synthetic speech by segmenting each of speech segments which are recorded and stored in advance into a plurality of micro-segments, and re-arranging the micro-segments obtained as a result of segmentation is available. Upon re-arranging these micro-segments, the micro-segments undergo processes such as interval change, repetition, skipping (thinning out), and the like, thus obtaining synthetic speech having a desired duration and fundamental frequency.

FIG. 17 illustrates the method of segmenting a speech waveform into micro-segments. The speech waveform shown in FIG. 17 is segmented into micro-segments by a cutting window function (to be referred to as a window function hereinafter). At this time, a window function synchronized with the pitch interval of source speech is used for a voiced sound part (latter half of the speech waveform). On the other hand, a window function with an appropriate interval is used for an unvoiced sound part.

By skipping one or plurality of micro-segments and using remaining micro-segments, as shown in FIG. 17, the continuation duration of speech can be shortened. On the other hand, by repetitively using these micro-segments, the continuation duration of speech can be extended. Furthermore, by narrowing the intervals between neighboring micro-segments in a voiced sound part, as shown in FIG. 17, the fundamental frequency of synthetic speech can be increased. On the other hand, by broadening the intervals between neighboring micro-segments in a voiced sound part, the fundamental frequency of synthetic speech can be decreased.

By superposing re-arranged micro-segments that have undergone the aforementioned repetition, skipping, and interval change processes, desired synthetic speech can be obtained. As units upon recording and storing speech segments, units such as phonemes, or CV·VC or VCV are used. CV·VC is a unit in which the segment boundary is set in phonemes, and VCV is a unit in which the segment boundary is set in vowels.

However, in the above conventional method, since a window function is applied to obtain micro-segments from a speech waveform, a speech spectrum suffers so-called "blur". That is, phenomena such broadened formant of speech, unsharp top and bottom peaks of a spectrum envelope, and the like occur, thus deteriorating the sound quality of synthetic speech.

SUMMARY OF THE INVENTION

Accordingly, it is desired to implement high-quality speech synthesis by reducing "blur" of a speech spectrum due to a window function applied to obtain micro-segments.

Further, it is desired to allow limited hardware resources to implement high-quality speech synthesis that can reduce "blur" of a speech spectrum.

According to the present invention, there is provided a speech synthesis method comprising:

an acquisition step (S2, S5, S32) of acquiring micro-segments from speech waveform data and a window function;

a re-arrangement step (S7, S34) of re-arranging the micro-segments acquired in the acquisition step to change prosody upon synthesis;

a synthesis step (S8, S9, S35, S36) of outputting synthetic speech waveform data on the basis of superposed waveform data obtained by superposing the micro-segments re-arranged in the re-arrangement step; and a correction step (S6, S201, S301, S401-S403, S33) of correcting at least one of the speech waveform data, the micro-segments, and the superposed waveform data using a spectrum correction filter formed based on the speech waveform data to be processed in the acquisition step.

According to the present invention, a speech synthesis apparatus which executes the aforementioned speech synthesis method, and a speech synthesis dictionary generation apparatus which executes the speech synthesis dictionary generation method are provided.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

Figure 1:
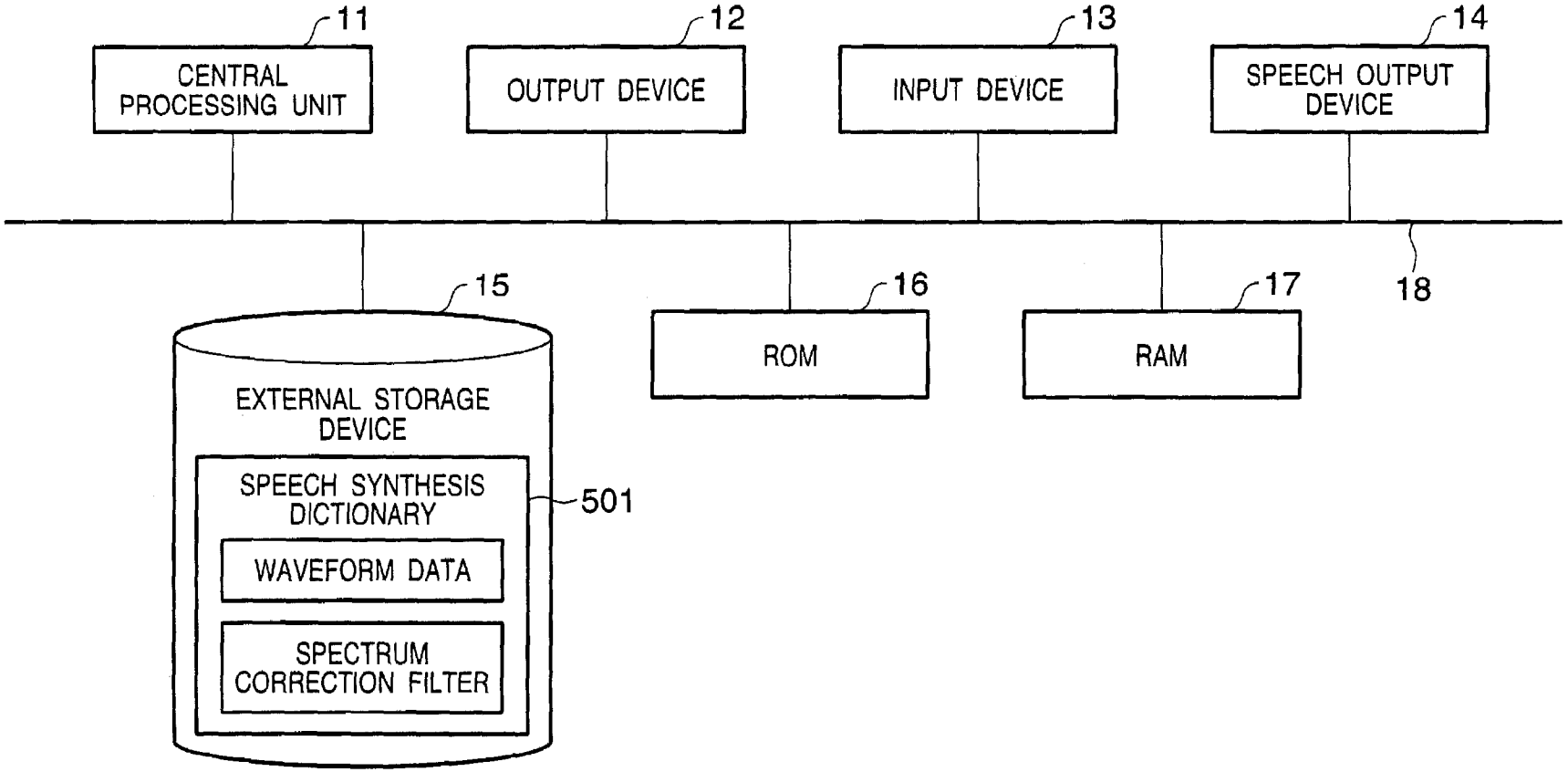
FIG. 1 is a block diagram showing the hardware arrangement of the first embodiment.

FIG. 1 is a block diagram showing the hardware arrangement of the first embodiment.

Referring to FIG. 1, reference numeral 11 denotes a central processing unit, which executes processes such as numerical value operations, control, and the like. Especially, the central processing unit 11 executes a speech synthesis process according to a sequence to be described later. Reference numeral 12 denotes an output device which presents various kinds of information to the user under the control of the central processing unit 11. Reference numeral 13 denotes an input device which comprises a touch panel, keyboard, or the like, and is used by the user to give operation instructions and to input various kinds of information to this apparatus. Reference numeral 14 denotes a speech output device which outputs speech synthesis contents.

Reference numeral 15 denotes a storage device such as a disk device, nonvolatile memory, or the like, which holds a speech synthesis dictionary 501 and the like. Reference numeral 16 denotes a read-only storage device which stores the sequence of a speech synthesis process of this embodiment, and required permanent data. Reference numeral 17 denotes a storage device such as a RAM or the like, which holds temporary information. The RAM 17 holds temporary data, various flags, and the like. The aforementioned building components (11 to 17) are connected via a bus 18. In this embodiment, the ROM 16 stores a control program for the speech synthesis process, and the central processing unit 11 executes that program. Alternatively, such control program may be stored in the external storage device 15, and may be loaded onto the RAM 17 upon execution of that program.

Figure 2:
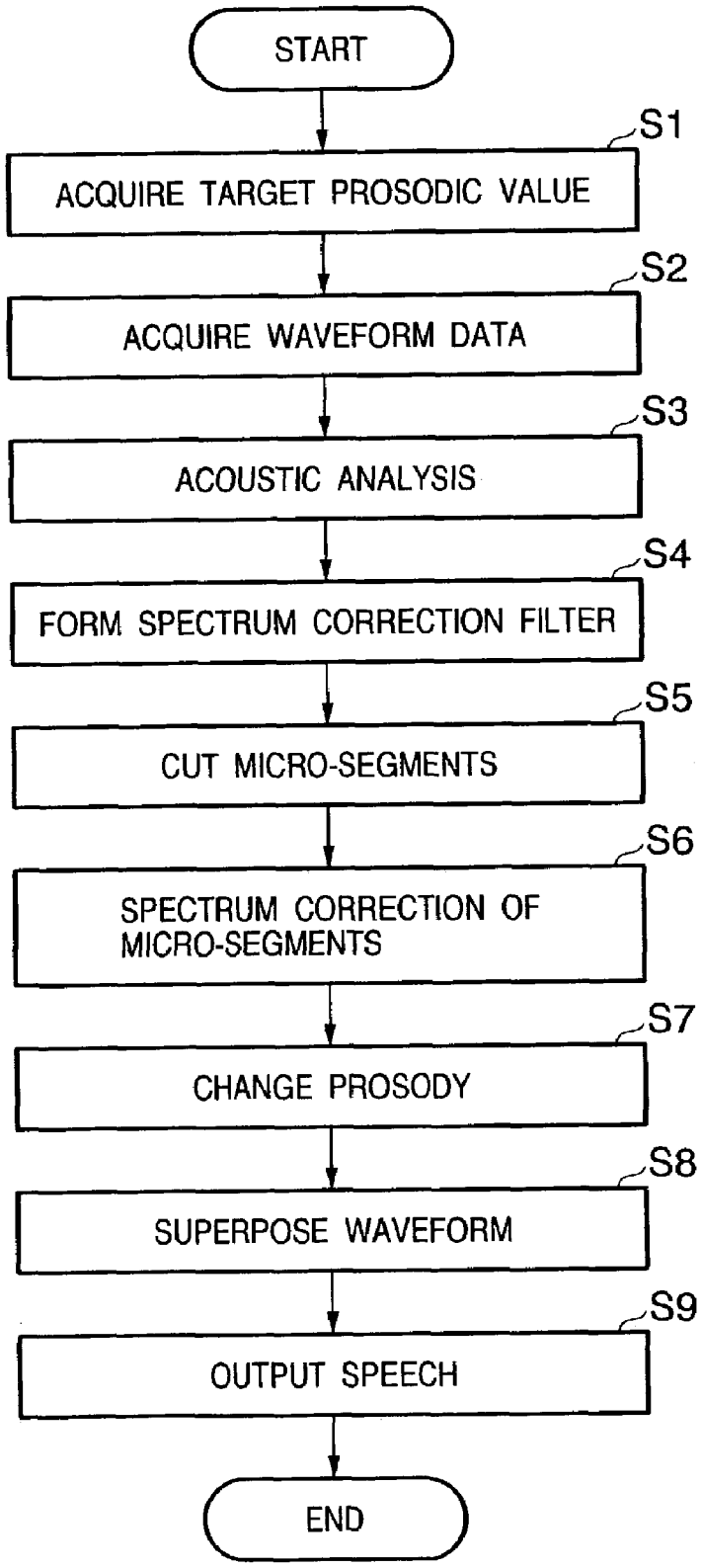
FIG. 2 is a flow chart for explaining a speech output process according to the first embodiment.
Figure 3:
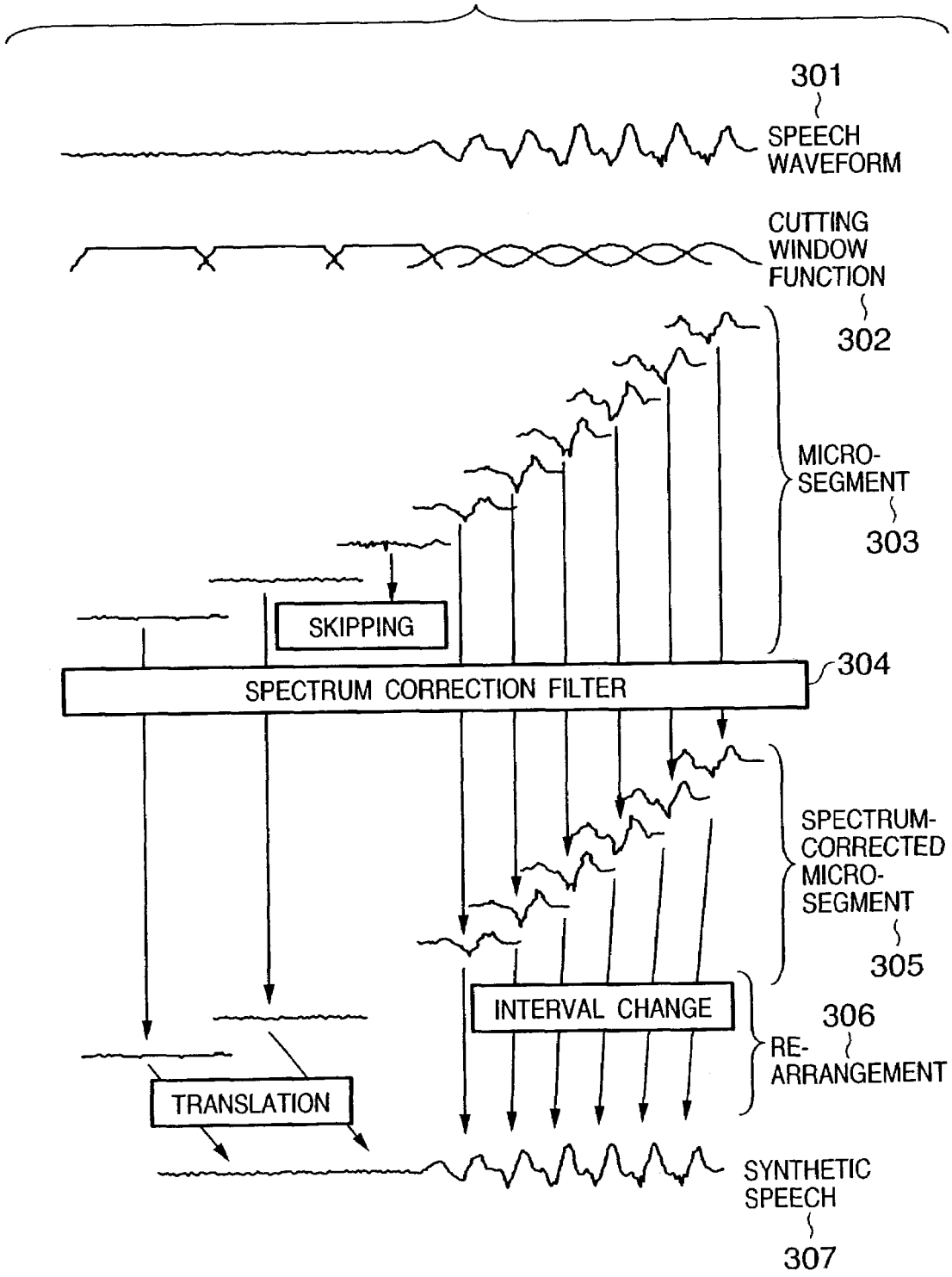
FIG. 3 shows a speech synthesis process state of the first embodiment.

The operation of the speech output apparatus of this embodiment with the above arrangement will be described below with reference to FIGS. 2 and 3. FIG. 2 is a flow chart for explaining a speech output process according to the first embodiment. FIG. 3 shows the speech synthesis state of the first embodiment.

In step S1, a target prosodic value of synthetic speech is acquired. The target prosodic value of synthetic speech may be directly given from a host module like in singing voice synthesis or may be estimated using some means. For example, in case of text-to-speech synthesis, the target prosodic value of synthetic speech is estimated based on the linguistic analysis result of text.

In step S2, waveform data (speech waveform 301 in FIG. 3) as a source of synthetic speech is acquired. In step S3, the acquired waveform data undergoes acoustic analysis such as linear prediction analysis, cepstrum analysis, generalized cepstrum analysis, or the like to calculate parameters required to form a spectrum correction filter 304. Note that analysis of waveform data may be done at given time intervals, or pitch synchronized analysis may be done.

In step S4, a spectrum correction filter is formed using the parameters calculated in step S3. For example, if linear prediction analysis of the p-th order is used as the acoustic analysis, a filter having characteristics given by:

$$F_1(z) = (1 - \mu z^{-1})\frac{1 + \sum_{j=1}^{p} \alpha_j (z/\gamma_1)^{-j}}{1 + \sum_{j=1}^{p} \alpha_j (z/\gamma_2)^{-j}} \tag{1}$$

is used as the spectrum correction filter. When equation (1) is used, linear prediction coefficients $\alpha_j$ are calculated in the parameter calculation.

On the other hand, if cepstrum analysis of the p-th order is used, a filter having characteristics given by:

$$F_2(z) = \exp\sum_{j=2}^{p} \gamma_3 c_j z^{-j} \tag{2}$$

is used as the spectrum correction filter. When equation (2) is used, cepstrum coefficients $c_j$ are calculated in the parameter calculation.

In these equations, $\mu$ and $\gamma$ are appropriate coefficients, $\alpha$ is a linear prediction coefficient, and c is a cepstrum coefficient.

Alternatively, an FIR filter which is formed by windowing the impulse response of the above filter at an appropriate order and is given by:

$$F_3(z) = 1 + \sum_{j=1}^{p'} \beta_j z^{-j} \tag{3}$$

may be used. When equation (3) is used, coefficients $\beta_j$ are calculated in the parameter calculation.

In practice, the above equations must consider system gains. The spectrum correction filter formed in this way is stored in the speech synthesis dictionary 501 (filter coefficients are stored in practice).

In step S5, a window function 302 is applied to the waveform acquired in step S2 to cut micro-segments 303. As the window function, a Hanning window or the like is used.

In step S6, the filter 304 formed in step S4 is applied to micro-segments 303 cut in step S5, thereby correcting the spectrum of the micro-segments cut in step S5. In this way, spectrum-corrected micro-segments 305 are acquired.

In step S7, the micro-segments 305 that have undergone spectrum correction in step S6 undergo skipping, repetition, and interval change processes to match the target prosodic value acquired in step S1, and are then re-arranged (306). In step S8, the micro-segments re-arranged in step S7 are superposed to obtain synthetic speech 307. Since speech obtained in step S8 is a speech segment, actual synthetic speech is obtained by concatenating a plurality of speech segments obtained in step S8. That is, in step S9 synthetic speech is output by concatenating speech segments obtained in step S8.

In the re-arrangement process of the micro-segments, "skipping" may be executed prior to application of the spectrum correction filter, as shown in FIG. 3. In this way, a wasteful process, i.e., a filter process for micro-segments which are discarded upon skipping, can be omitted.

Second Embodiment

In the first embodiment, the spectrum correction filter is formed upon speech synthesis. Alternatively, the spectrum correction filter may be formed prior to speech synthesis, and formation information (filter coefficients) required to form the filter may be held in a predetermined storage area. That is, the process of the first embodiment can be separated into two processes, i.e., data generation (FIG. 4) and speech synthesis (FIG. 5). The second embodiment will explain processes in such case. Note that the apparatus arrangement required to implement the processes of this embodiment is the same as that in the first embodiment (FIG. 1). In this embodiment, formation information of a correction filter is stored in the speech synthesis dictionary 501.

Figure 4:
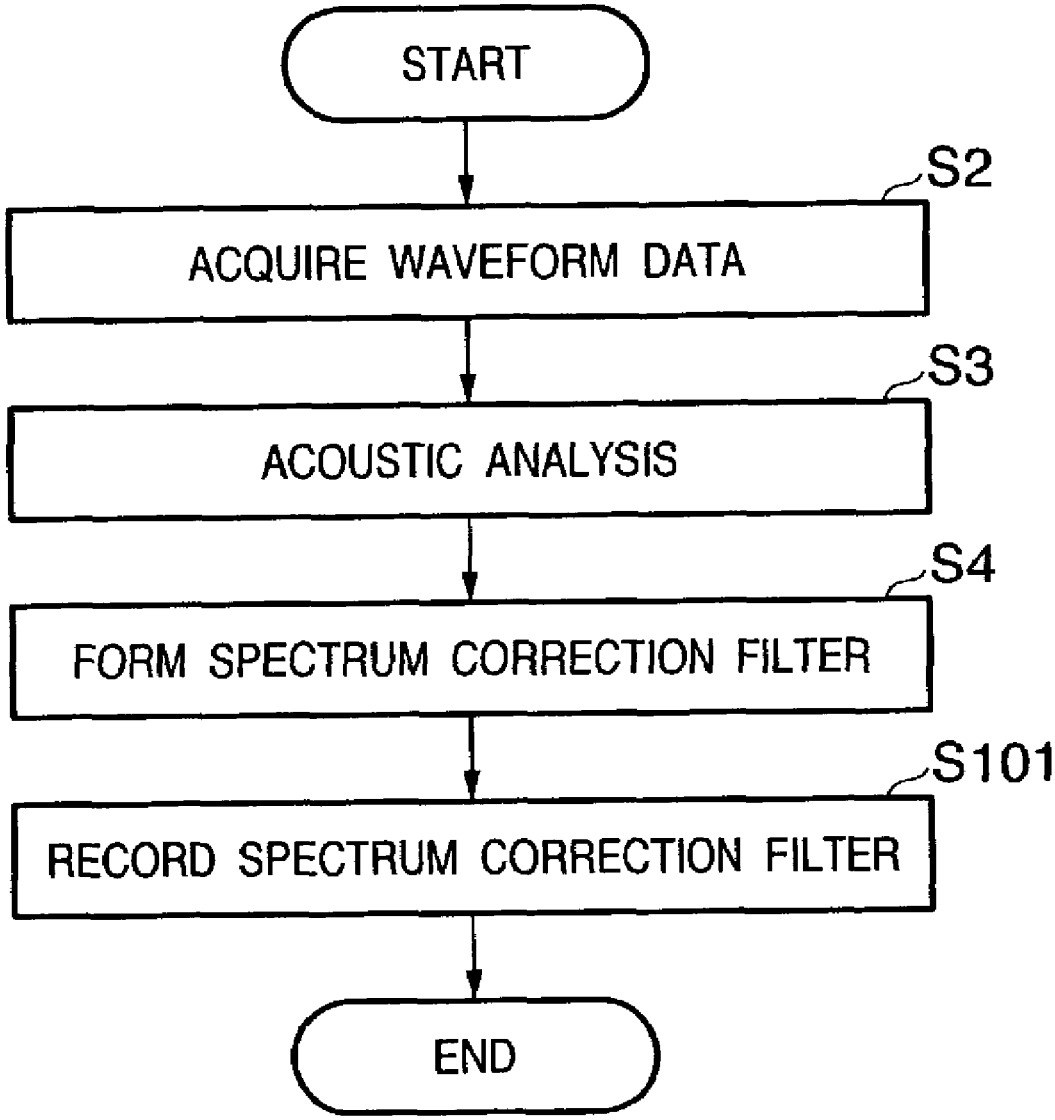
FIG. 4 is a flow chart for explaining a spectrum correction filter registration process in a speech output process according to the second embodiment.
Figure 5:
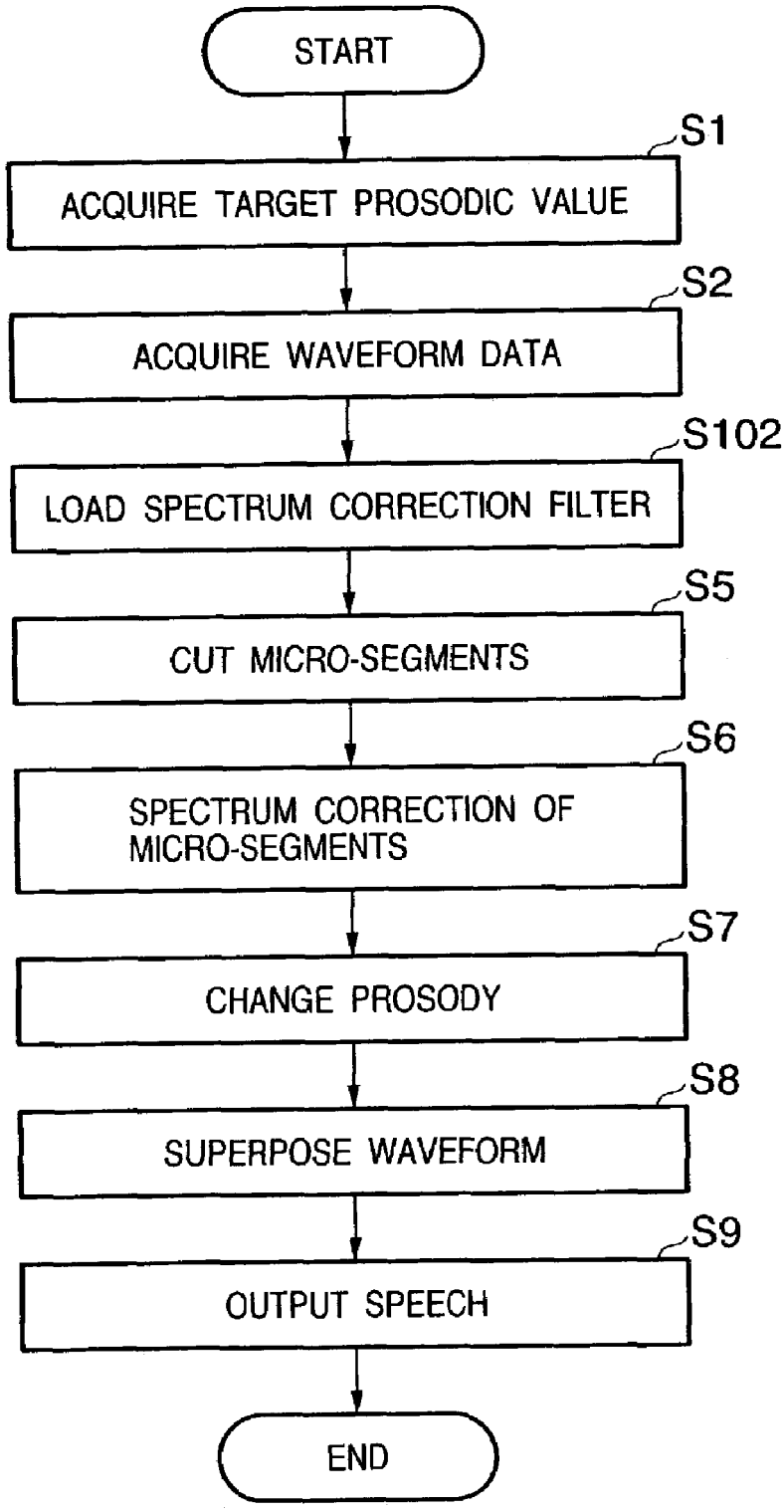
FIG. 5 is a flow chart for explaining a speech synthesis process in the speech output process according to the second embodiment.

In the flow chart in FIG. 4, steps S2, S3, and S4 are the same as those in the first embodiment (FIG. 2). In step S101, filter coefficients of a spectrum correction filter formed in step S4 are recorded in the external storage device 15. In the second embodiment, spectrum correction filters are formed in correspondence with respective waveform data registered in the speech synthesis dictionary 501, and coefficients of the filters corresponding to the respective waveform data are held in the speech synthesis dictionary 501. That is, the speech synthesis dictionary 501 of the second embodiment registers waveform data and spectrum correction filters of respective speech waveforms.

On the other hand, upon speech synthesis, as shown in the flow chart of FIG. 5, steps S3 and S4 in the process of the first embodiment are omitted, and step S102 (load a spectrum correction filter) is added instead. In step S102, spectrum correction filter coefficients recorded in step S101 in FIG. 4 are loaded. That is, coefficients of a spectrum correction filter corresponding to waveform data acquired in step S2 are loaded from the speech synthesis dictionary 501 to form the spectrum correction filter. In step S6, a micro-segment process is executed using the spectrum correction filter loaded in step S102.

As described above, when spectrum correction filters are recorded in advance in correspondence with all waveform data, a spectrum correction filter need not be formed upon speech synthesis. For this reason, the processing volume upon speech synthesis can be reduced compared to the first embodiment.

Third Embodiment

In the first and second embodiments, a filter formed in step S4 (form a spectrum correction filter) is applied to micro-segments cut in step S5 (cut micro-segments). However, the spectrum correction filter may be applied to waveform data (speech waveform 301) acquired in step S2. The third embodiment will explain such speech synthesis process. Note that the apparatus arrangement required to implement the process of this embodiment is the same as that in the first embodiment (FIG. 1).

Figure 6:
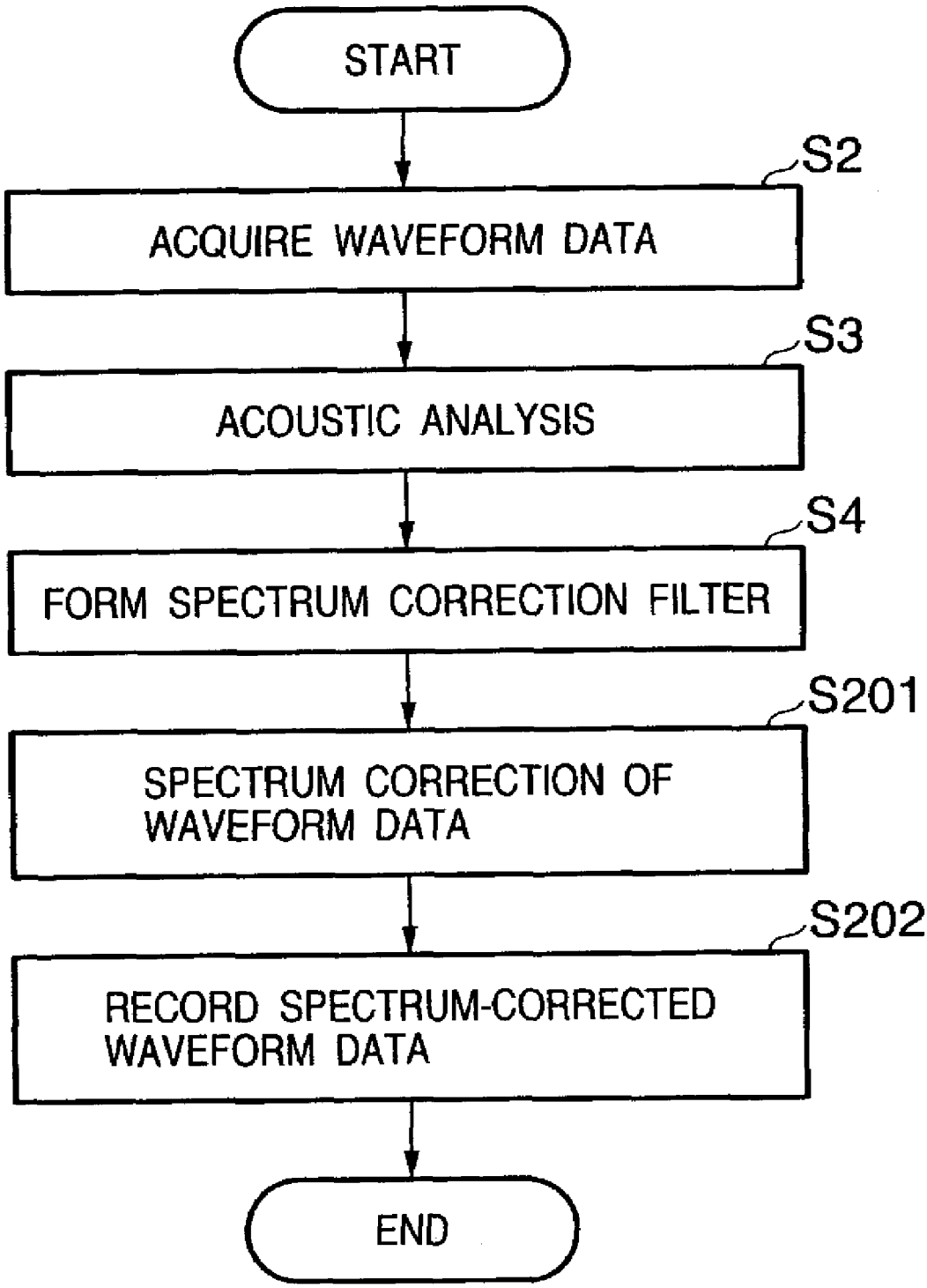
FIG. 6 is a flow chart for explaining a spectrum correction filter registration process in a speech output process according to the third embodiment.

FIG. 6 is a flow chart for explaining a speech synthesis process according to the third embodiment. Referring to FIG. 6, steps S2 to S4 are the same as those in the second embodiment. In the third embodiment, after a spectrum correction filter is formed in step S4, in step S201 it is applied to waveform data acquired in step S2, thus correcting the spectrum of the waveform data in step S201.

In step S202, the waveform data that has undergone spectrum correction in step S201 is recorded. That is, in the third embodiment, the speech synthesis dictionary 501 in FIG. 1 stores "spectrum-corrected waveform data" in place of "spectrum correction filter". Note that speech waveform data may be corrected during the speech synthesis process without being registered in the speech synthesis dictionary. In this case, for example, waveform data read in step S2 in FIG. 2 is corrected using the spectrum correction filter formed in step S4, and the corrected waveform data can be used in step S5. In this case, step S6 can be omitted.

Figure 7:
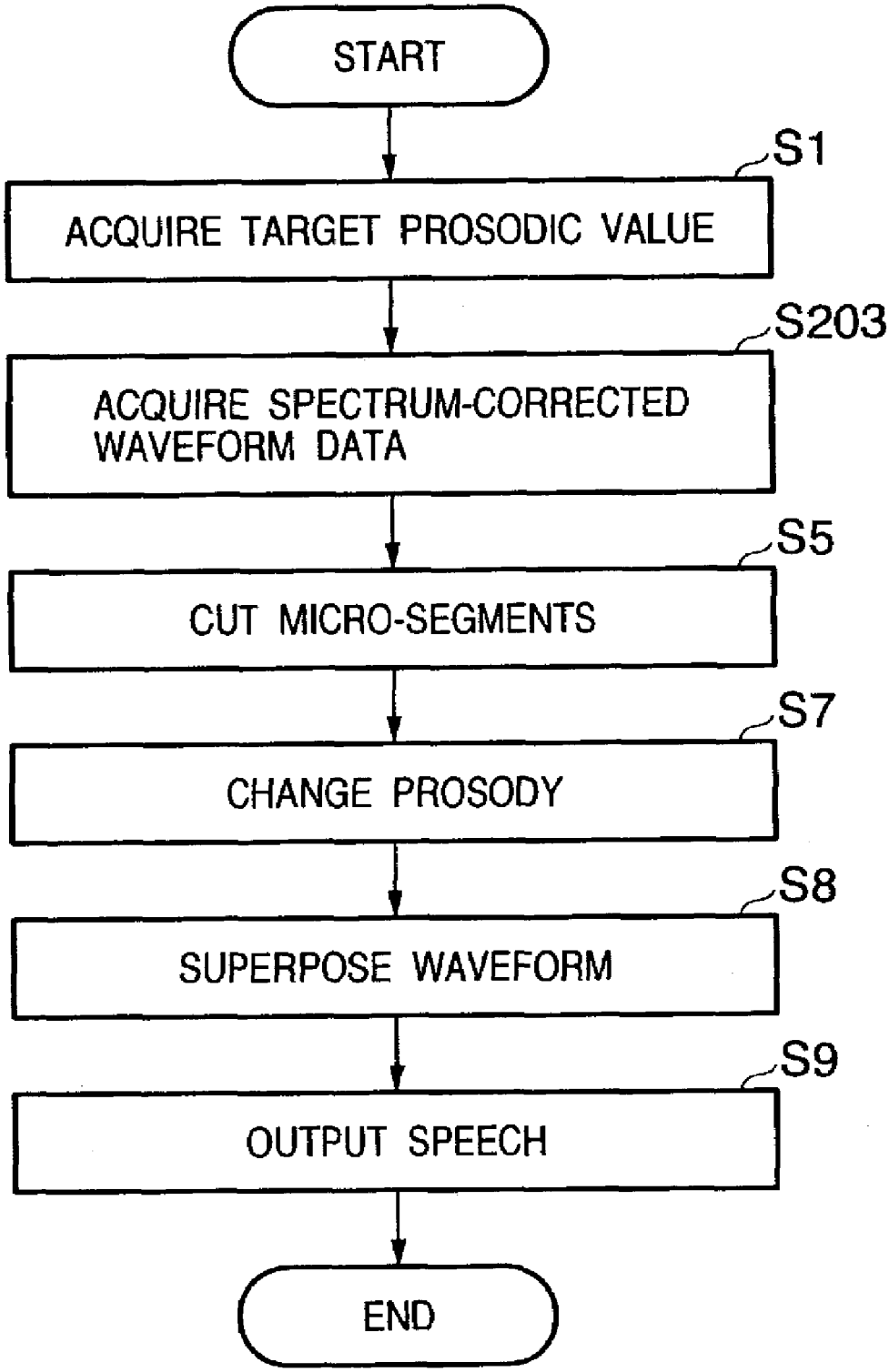
FIG. 7 is a flow chart for explaining a speech synthesis process in the speech output process according to the third embodiment.

On the other hand, in the speech synthesis process, the process shown in the flow chart of FIG. 7 is executed. In the third embodiment, step S203 is added in place of step S2 in the above embodiments. In this step, the spectrum-corrected waveform data recorded in step S202 is acquired as that from which micro-segments are to be cut in step S5. Micro-segments are cut from the acquired waveform data, and are re-arranged, thus obtaining spectrum-corrected synthetic speech. Since the spectrum-corrected waveform data is used, a spectrum correction process (step S6 in the first and second embodiments) for micro-segments can be omitted.

When the spectrum correction filter is applied not to micro-segments but to waveform data like in the third embodiment, the influence of a window function used in step S5 cannot be perfectly removed. That is, sound quality is slightly inferior to that in the first and second embodiments. However, since processes up to filtering using the spectrum correction filter can be done prior to speech synthesis, the processing volume upon speech synthesis (FIG. 7) can be greatly reduced compared to the first and second embodiments.

In the third embodiment, the speech output process is separated into two processes, i.e., data generation and speech synthesis like in the second embodiment. Alternatively, filtering may be executed every time a synthesis process is executed like in the first embodiment. In this case, the spectrum correction filter is applied to waveform data, which is to undergo a synthesis process, between steps S4 and S5 in the flow chart shown in FIG. 2. Also, step S6 can be omitted.

Fourth Embodiment

In the first and second embodiments, the filter formed in step S4 is applied to micro-segments cut in step S5. In the third embodiment, the filter formed in step S4 is applied to waveform data before micro-segments are cut. However, the spectrum correction filter may be applied to waveform data of synthetic speech synthesized in step S8. The fourth embodiment will explain a process in such case. Note that the apparatus arrangement required to implement the process of this embodiment is the same as that in the first embodiment (FIG. 1).

Figure 8:
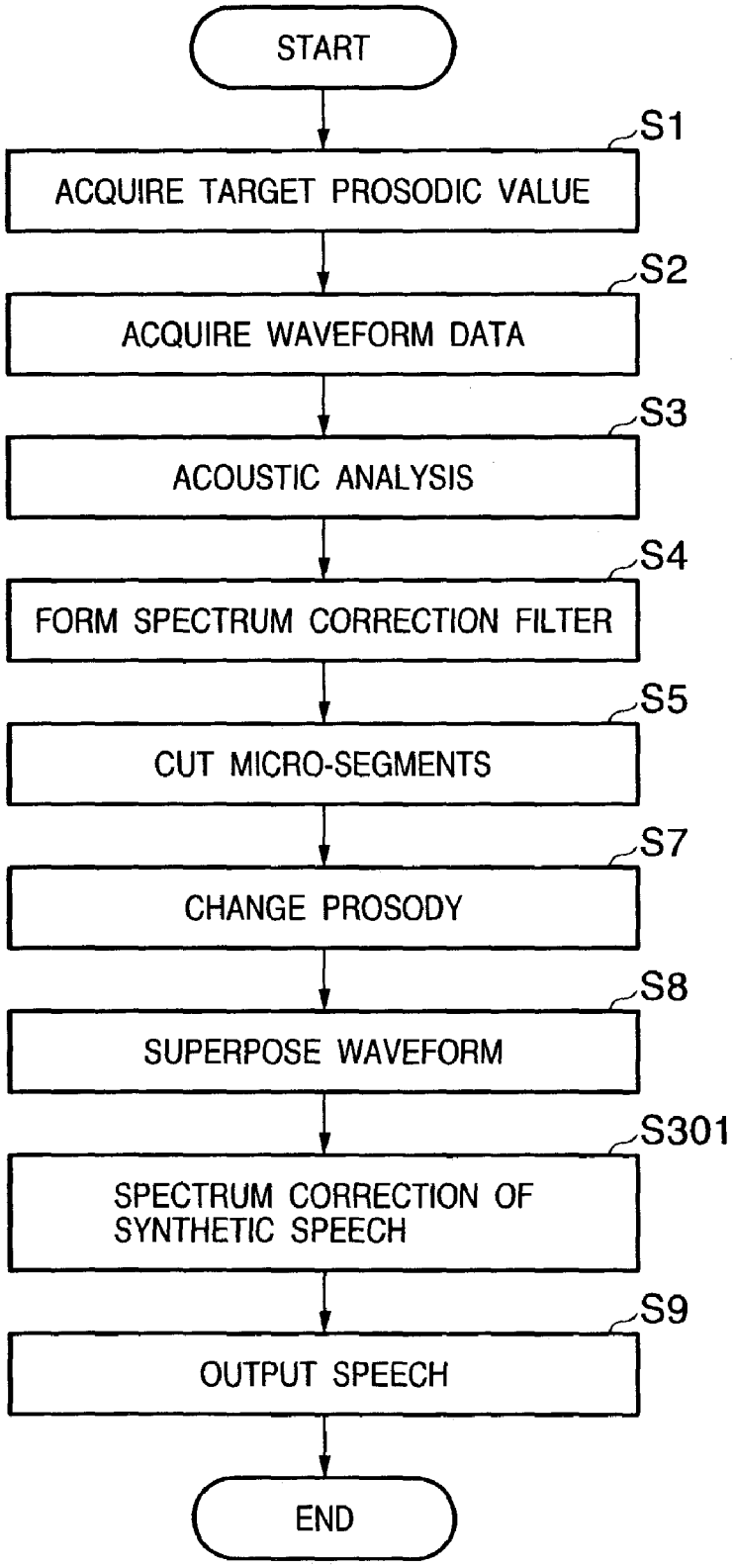
FIG. 8 is a flow chart for explaining a speech output process according to the fourth embodiment.

FIG. 8 is a flow chart for explaining a speech synthesis process according to the fourth embodiment. The same step numbers in FIG. 8 denote the same processes as those in the first embodiment (FIG. 2). In the fourth embodiment, step S301 is inserted after step S8, and step S6 is omitted, as shown in FIG. 8. In step S301, the filter formed in step S4 is applied to waveform data of synthetic speech obtained in step S8, thus correcting its spectrum.

According to the fourth embodiment, for example, when the number of times of repetition of identical micro-segment is small as a result of step S7, the processing volume can be reduced compared to the first embodiment.

In this embodiment, the spectrum correction filter may be formed in advance as in the first and second embodiments. That is, filter coefficients are pre-stored in the speech synthesis dictionary 501, and are read out upon speech synthesis to form a spectrum correction filter, which is applied to waveform data that has undergone waveform superposition in step S8.

Fifth Embodiment

If the spectrum correction filter can be expressed as a synthetic filter of a plurality of partial filters, spectrum correction can be distributed to a plurality of steps in place of executing spectrum correction in one step in the first to fourth embodiments. By distributing the spectrum correction, the balance between the sound quality and processing volume can be flexibly adjusted compared to the above embodiments. The fifth embodiment will explain a speech synthesis process to be implemented by distributing the spectrum correction filter. Note that the apparatus arrangement required to implement the process of this embodiment is the same as that in the first embodiment (FIG. 1).

Figure 9:
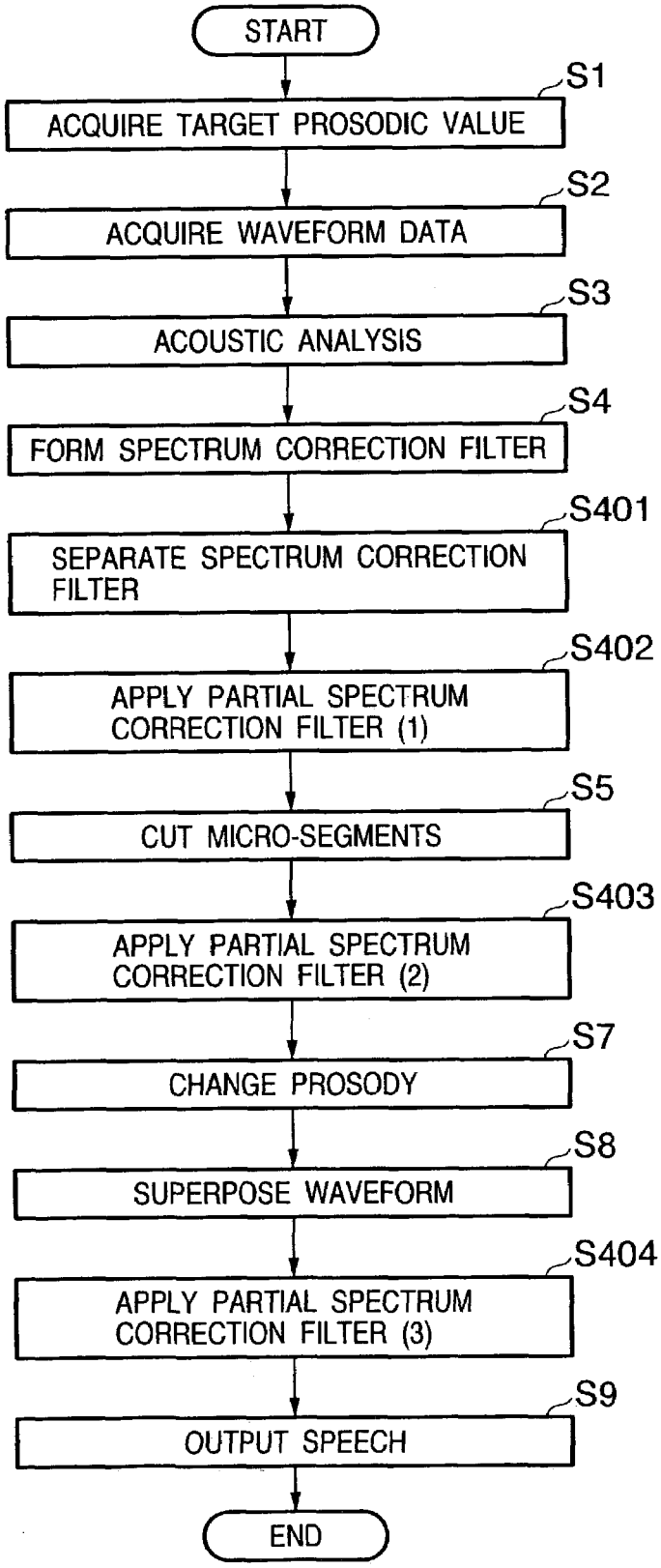
FIG. 9 is a flow chart for explaining a speech output process according to the fifth embodiment.

FIG. 9 is a flow chart for explaining the speech synthesis process according to the fifth embodiment. As shown in FIG. 9, processes in steps S1 to S4 are executed first. These processes are the same as those in steps S1 to S4 in the first to fourth embodiments.

In step S401, the spectrum correction filter formed in step S4 is degenerated into two to three partial filters (element filters). For example, spectrum correction filter $F_1(z)$ adopted when linear prediction analysis of the p-th order is used in the acoustic analysis is expressed as the product of denominator and numerator polynomials by:

$$F_1(z) = F_{1,1}(z)F_{1,2}(z) \tag{4}$$

$$F_{1,1}(z) = (1-\mu z^{-1})\left(1+\sum_{j=1}^{p}\alpha_j(z/\gamma_1)^{-j}\right)$$

$$F_{1,2}(z) = \frac{1}{1+\sum_{j=1}^{p}\alpha_j(z/\gamma_2)^{-1}}$$

Alternatively, the numerator and denominator polynomials may be factorized to the product of linear or quadratic real coefficient polynomials by:

$$F_1(z) = F_{1,1}(z)F_{1,2}(z)F_{1,3}(z) \tag{5}$$

$$F_{1,1}(z) = (1-\mu z^{-1})\prod_{j=1}^{q}\frac{a_{j,0}+a_{j,1}(z/\gamma_1)^{-1}+a_{j,2}(z/\gamma_1)^{-2}}{a_{j,0}+a_{j,1}(z/\gamma_2)^{-1}+a_{j,2}(z/\gamma_2)^{-2}}$$

$$F_{1,2}(z) = \prod_{j=q+1}^{r}\frac{a_{j,0}+a_{j,1}(z/\gamma_1)^{-1}+a_{j,2}(z/\gamma_1)^{-2}}{a_{j,0}+a_{j,1}(z/\gamma_2)^{-1}+a_{j,2}(z/\gamma_2)^{-2}}$$

$$F_{1,3}(z) = \prod_{j=r+1}^{p/2}\frac{a_{j,0}+a_{j,1}(z/\gamma_1)^{-1}+a_{j,2}(z/\gamma_1)^{-2}}{a_{j,0}+a_{j,1}(z/\gamma_2)^{-1}+a_{j,2}(z/\gamma_2)^{-2}}$$

Likewise, when an FIR filter is used as the spectrum correction filter, it can be factorized to the product of linear or quadratic real coefficient polynomials. That is, equation (3) is factorized and is expressed as:

$$F_3(z) = \prod_{j\in c_1}(b_{j,0}+b_{j,1}z^{-1}+b_{j,2}z^{-2}) \tag{6}$$

$$\prod_{j\in c_2}(b_{j,0}+b_{j,1}z^{-1}+b_{j,2}z^{-2})\prod_{j\in c_3}(b_{j,0}+b_{j,1}z^{-1}+b_{j,2}z^{-2})$$

On the other hand, when cepstrum analysis of the p-th order is used, since the filter characteristics can be expressed by exponents, cepstrum coefficients need only be grouped like:

$$F_2(z) = \left(\exp\sum_{j\in c_1}\gamma_3 c_j z^{-j}\right)\left(\exp\sum_{j\in c_2}\gamma_3 c_j z^{-j}\right)\left(\exp\sum_{j\in c_3}\gamma_3 c_j z^{-j}\right) \tag{7}$$

In step S402, waveform data acquired in step S2 is filtered using one of the filters degenerated in step S401. That is, waveform data before micro-segments are cut undergoes a spectrum correction process using a first filter element as one of a plurality of filter elements obtained in step S401.

In step S5, a window function is applied to waveform data obtained as a result of partial application of the spectrum correction filter in step S402 to cut micro-segments. In step S403, the micro-segments cut in step S5 undergo filtering using another one of the filters degenerated in step S401. That is, the cut micro-segments undergo a spectrum correction process using a second filter element as one of the plurality of filter elements obtained in step S401.

After that, steps S7 and S8 are executed as in the first and second embodiments. In step S404, synthetic speech obtained in step S8 undergoes filtering using still another one of the filters degenerated in step S401. That is, the waveform data of the obtained synthetic speech undergoes a spectrum correction process using a third filter element as one of the plurality of filter elements obtained in step S401.

In step S9, the synthetic speech obtained as a result of step S404 is output.

In the above arrangement, when degeneration like equations (5) is made, $F_{1,1}(z)$, $F_{1,2}(z)$, and $F_{1,3}(z)$ can be respectively used in steps S402, S403, and S404.

When the filter is divided as the product of two elements like in equations (4), no filtering is done in one of steps S402, S403, and S404. That is, when the spectrum correction filter is degenerated into two filters in step S401 (in this example, the filter is degenerated into two polynomials, i.e., denominator and numerator polynomials), one of steps S402, S403, and S404 is omitted.

In the fifth embodiment as well, the spectrum correction filter or element filters may be registered in advance in the speech synthesis dictionary 501 as in the first and second embodiments.

As described above, according to the fifth embodiment, there is a certain amount of freedom in assignment of polynomials (filters) and steps (S402, S403, S404), and the balance between the sound quality and processing volume changes depending on that assignment. Especially, in case of equations (5), equations (7), or equations (6) obtained by factorizing the FIR filter, the number of factors to be assigned to each step can also be controlled, thus assuring more flexibility.

In each of the first to fifth embodiments, the spectrum correction filter coefficients may be recorded after they are quantized by, e.g., vector quantization or the like, in place of being directly recorded. In this way, the data size to be recorded on the external storage device 15 can be reduced.

At this time, when LPC analysis or generalized cepstrum analysis is used as acoustic analysis, the quantization efficiency can be improved by converting filter coefficients into line spectrum pairs (LSPs) and then quantizing them.

When the sampling frequency of waveform data is high, the waveform data may be split into bands using a band split filter, and each individual band-limited waveform may undergo spectrum correction filtering. As a result of band split, the order of the spectrum correction filter can be suppressed, and the calculation volume can be reduced. The same effect is expected by expanding/compressing the frequency axis like mel-cepstrum.

As has been explained in the first to fifth embodiments, the timing of spectrum correction filtering has a plurality of choices. The timing of spectrum correction filtering and ON/OFF control of spectrum correction may be selected for respective segments. As information for selection, the phoneme type, voiced/unvoiced type, and the like may be used.

In the first to fifth embodiments, as an example of the spectrum correction filter, a formant emphasis filter that emphasizes the formant may be used.

As described above, according to the present invention, "blur" of a speech spectrum due to a window function applied to obtain micro-segments can be reduced, and speech synthesis with high sound quality can be realized.

Sixth Embodiment

Figure 17:
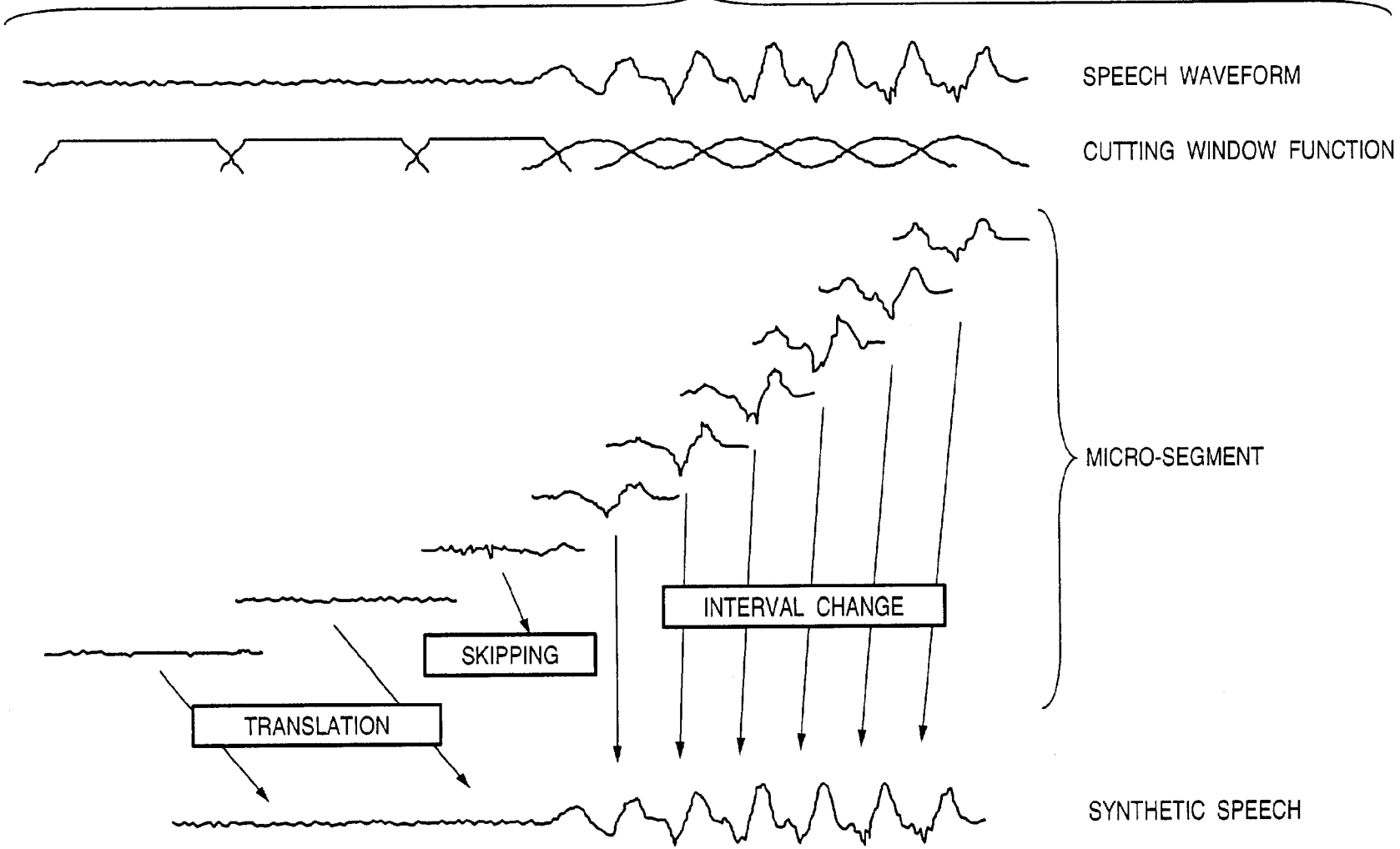
FIG. 17 illustrates a general method using spectrum correction in a speech synthesis method which obtains speech by segmenting a speech waveform into micro-segments, rearranging the micro-segments, and synthesizing the re-arranged micro-segments.

The first to fifth embodiments have explained the speech synthesis apparatus and method, which reduce "blur" of a speech spectrum by correcting the spectra of micro-segments by applying the spectrum correction filter to the micro-segments shown in FIG. 17. Such process can relax phenomena such a broadened formant of speech, unsharp top and bottom peaks of a spectrum envelope, and the like, which have occurred due to application of a window function to obtain micro-segments from a speech waveform, and can prevent the sound quality of synthetic speech from deteriorating.

For example, in the first embodiment, in FIG. 3, a corresponding spectrum filter 304 is applied to each of micro-segments 303 which are cut from a speech waveform 301 by a window function 302, thus obtaining spectrum-corrected micro-segments 305 (e.g., formant-corrected micro-segments). Then, synthetic speech 307 is generated using the spectrum-corrected micro-segments 305.

Note that the spectrum correction filter is obtained by acoustic analysis. As examples of the spectrum correction filter 304 that can be applied to the above process, the following three filters are listed:

(1) a spectrum correction filter having characteristics given by equation (1) when linear prediction analysis of the p-th order is used as acoustic analysis;

(2) a spectrum correction filter having characteristics given by equation (2) when cepstrum analysis of the p-th order is used as acoustic analysis; and (3) an FIR filter which is formed by windowing the impulse response of the filter at an appropriate order and is expressed by equation (3).

Upon calculating the spectrum correction filter, at least ten to several ten product sum calculations are required per waveform sample. Such calculation volume is much larger than that of the basic process (the process shown in FIG. 8) of speech synthesis. Normally, since the correction filter coefficients are calculated upon generating a speech synthesis dictionary, a storage area for holding the correction filter coefficients is required. That is, the size of the speech synthesis dictionary becomes enlarged.

Of course, if the filter order p or FIR filter order p' is reduced, the calculation volume and storage size can be reduced. Alternatively, by clustering spectrum correction filter coefficients, the storage size required to hold the spectrum correction filter coefficients can be reduced. However, in such cases, the spectrum correction effect is reduced, and the sound quality deteriorates. Hence, in the embodiments to be described hereinafter, "blur" of a speech spectrum is reduced and speech synthesis with high sound quality is realized, while suppressing increases in calculation volume and storage size by reducing those required for spectrum correction filtering.

The sixth embodiment reduces the calculation volume and storage size using an approximate filter with a smaller filter order, and waveform data in the speech synthesis dictionary is modified to be suited to the approximate filter, thus maintaining the high quality of synthetic speech.

Figure 10:
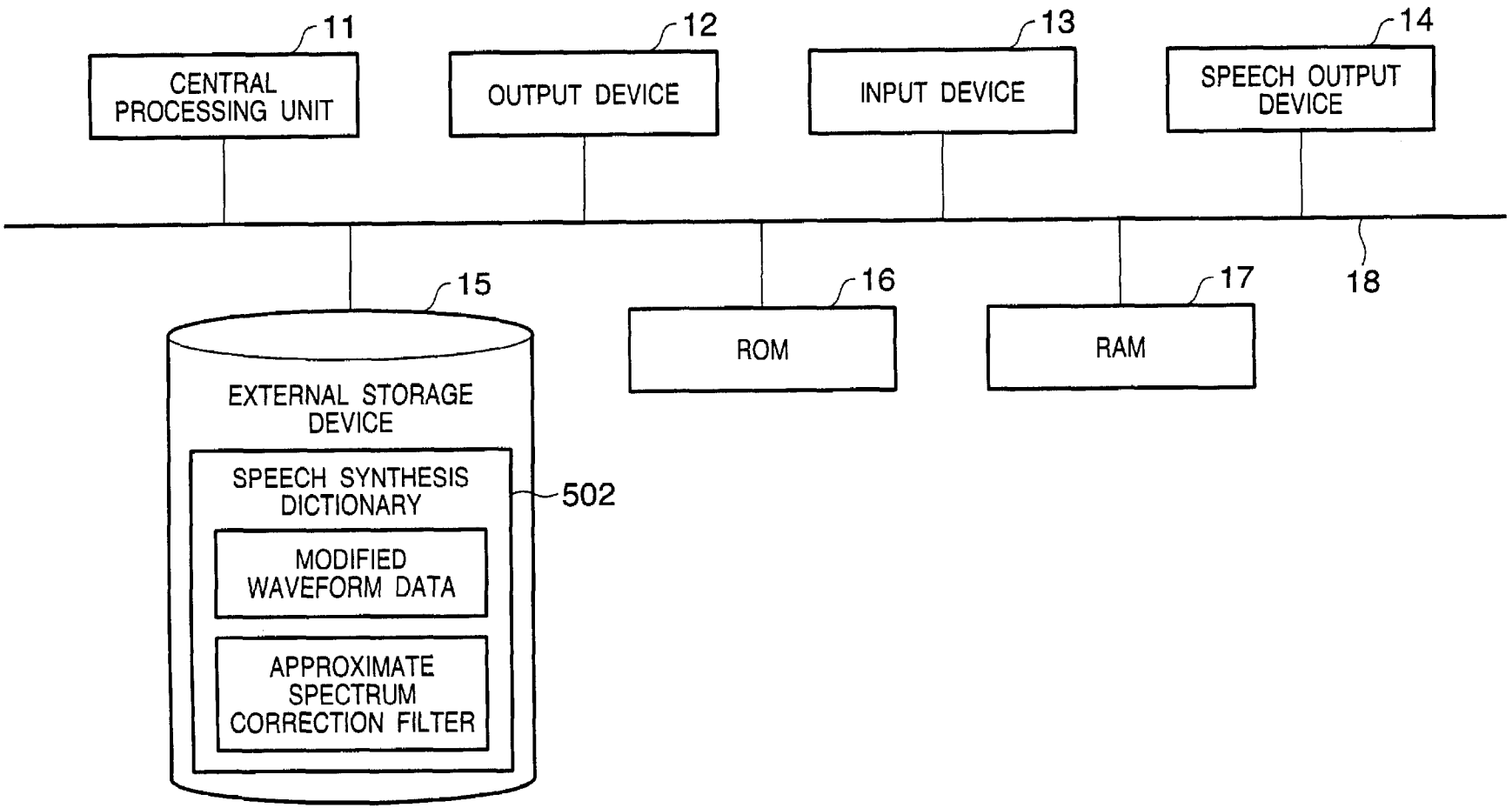
FIG. 10 is a block diagram showing the hardware arrangement of the sixth embodiment.

FIG. 10 is a block diagram showing the hardware arrangement in the sixth embodiment. The same reference numerals in FIG. 10 denote the same parts as those in FIG. 1 explained in the first embodiment.

Note that the external storage device 15 holds a speech synthesis dictionary 502 and the like. The speech synthesis dictionary 502 stores modified waveform data generated by modifying a speech waveform by a method to be described later, and a spectrum correction filter formed by approximation using a method to be described later.

Figure 11:
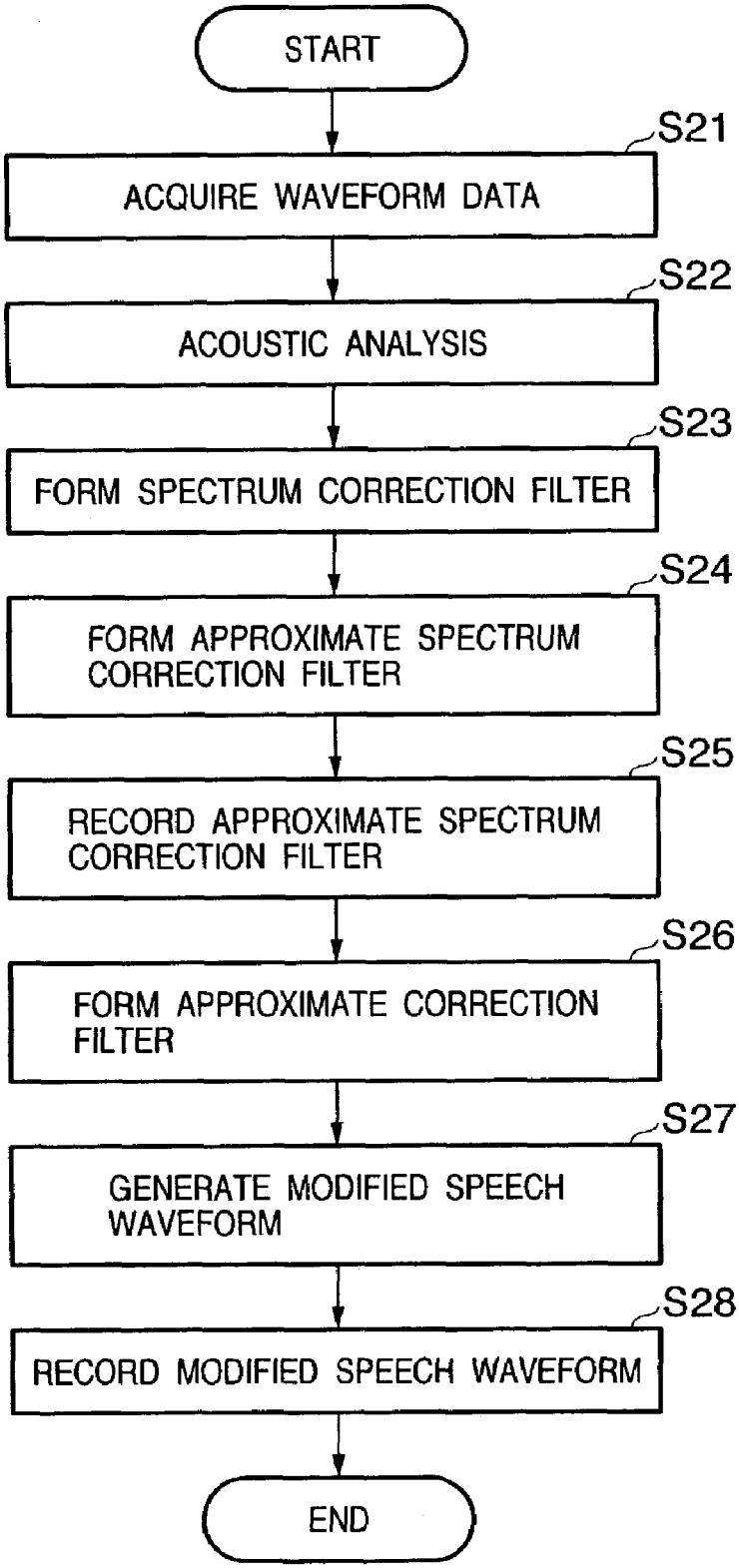
FIG. 11 is a flow chart for explaining an approximate spectrum correction filter in a speech output process according to the sixth embodiment.
Figure 12:
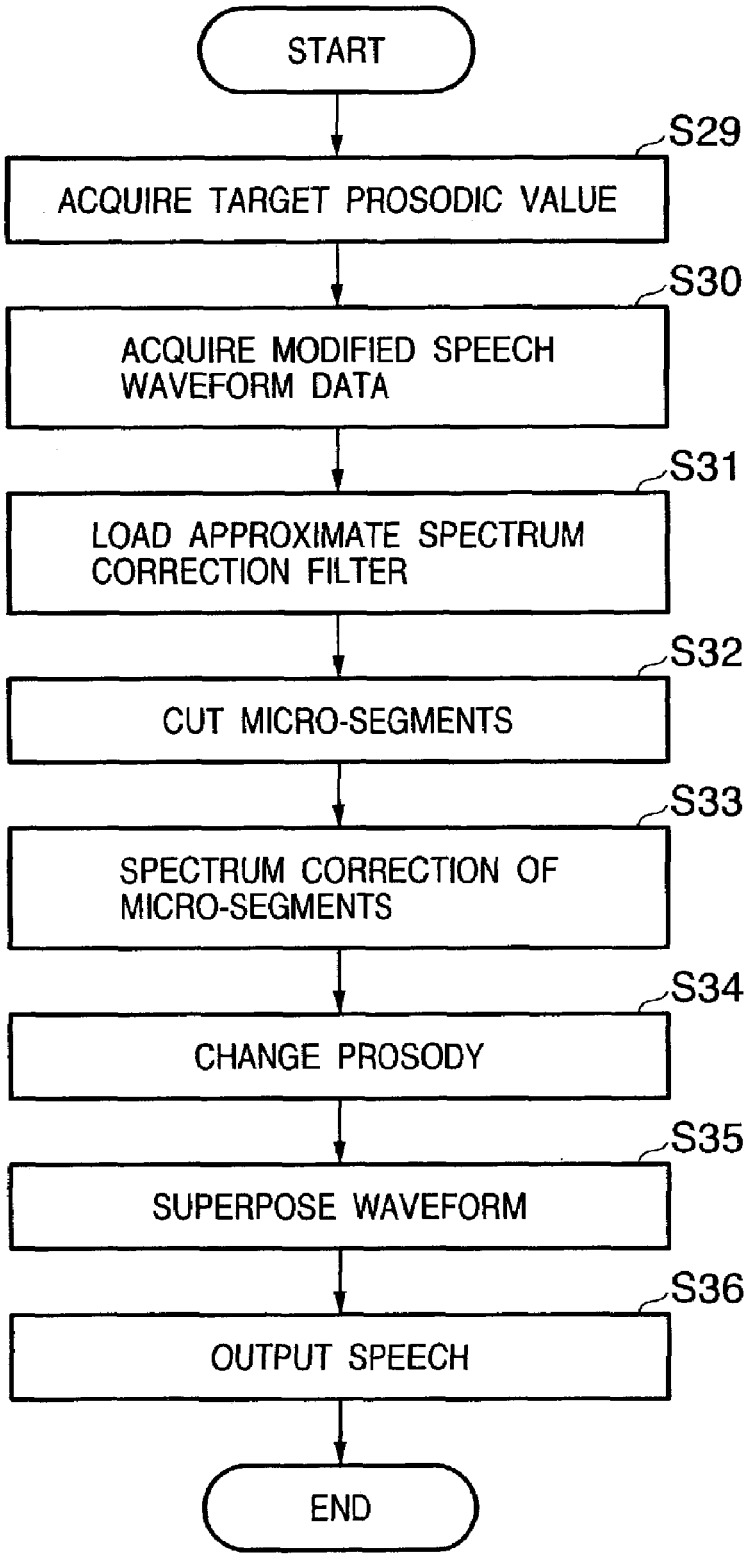
FIG. 12 is a flow chart for explaining a speech synthesis process in the speech output process according to the sixth embodiment.
Figure 13:
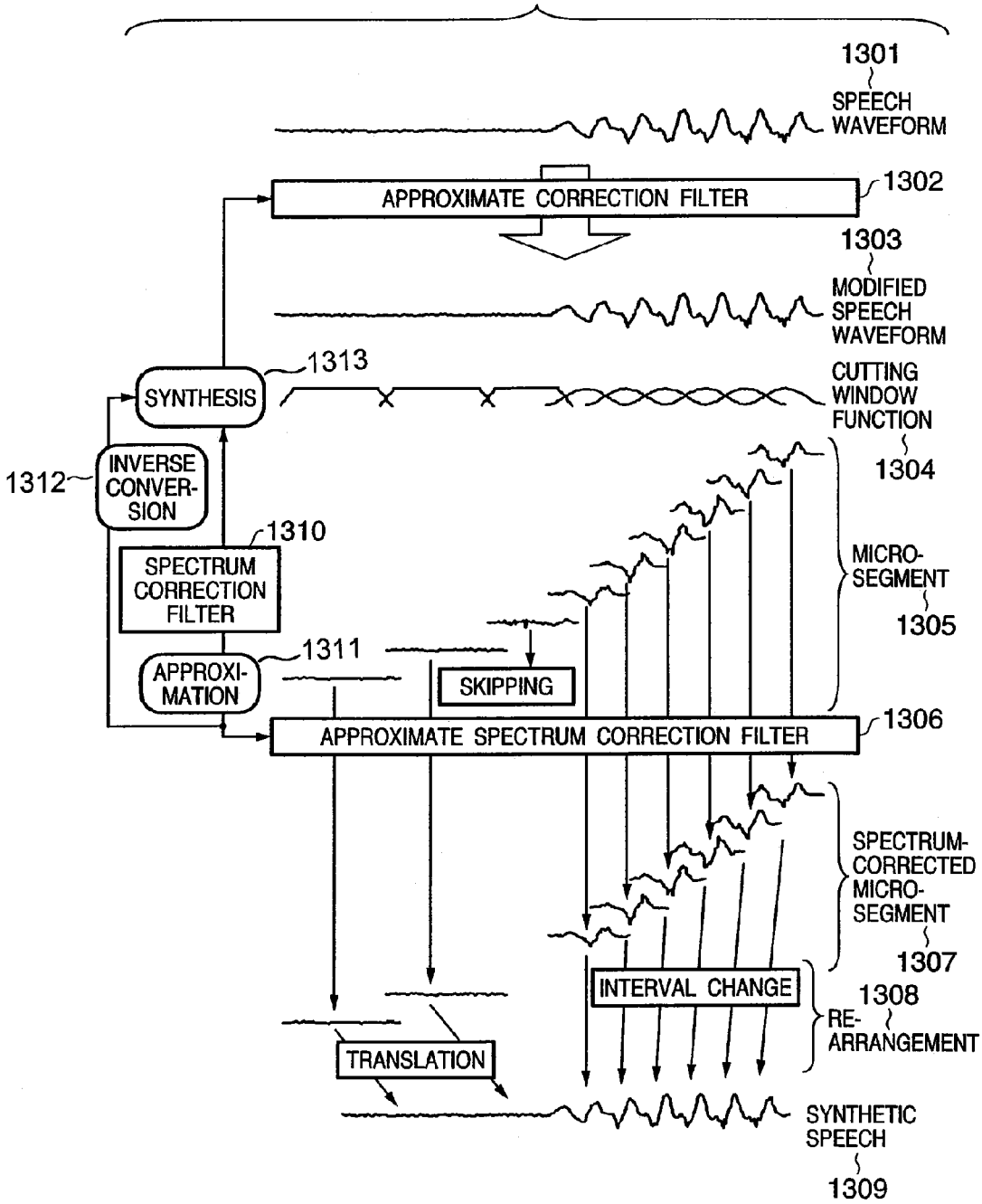
FIG. 13 shows the speech synthesis process state according to the sixth embodiment.

The operation of the speech output apparatus of this embodiment with the above arrangement will be described below with reference to FIGS. 11, 12, and 13. FIGS. 11 and 12 are flow charts for explaining a speech output process according to the sixth embodiment. FIG. 13 shows the speech synthesis process state according to the sixth embodiment.

In the sixth embodiment, a spectrum correction filter is formed prior to speech synthesis, and formation information (filter coefficients) required to form the filter is held in a predetermined storage area (speech synthesis dictionary) as in the second embodiment. That is, the speech output process of the sixth embodiment is divided into two processes, i.e., a data generation process (FIG. 11) for generating a speech synthesis dictionary, and a speech synthesis process (FIG. 12). In the data generation process, the information size of formation information is reduced by adopting approximation of a spectrum correction filter, and each speech waveform in the speech synthesis dictionary is modified to prevent deterioration of synthetic speech due to approximation of the spectrum correction filter.

In step S21, waveform data (speech waveform 1301 in FIG. 13) as a source of synthetic speech is acquired. In step S22, the waveform data acquired in step S21 undergoes acoustic analysis such as linear prediction analysis, cepstrum analysis, generalized cepstrum analysis, or the like to calculate parameters required to form a spectrum correction filter 1310. Note that analysis of waveform data may be done at given time intervals, or pitch synchronized analysis may be done.

In step S23, a spectrum correction filter 1310 is formed using the parameters calculated in step S22. For example, if linear prediction analysis of the p-th order is used as the acoustic analysis, a filter having characteristics given by equation (1) is used as the spectrum correction filter 1310. If cepstrum analysis of the p-th order is used, a filter having characteristics given by equation (2) is used as the spectrum correction filter 1310. Alternatively, an FIR filter which is formed by windowing the impulse response of the above filter at an appropriate order and is given by equation (3) can be used as the spectrum correction filter 1310. In practice, the above equations must consider the system gains.

In step S24, the spectrum correction filter 1310 formed in step S23 is simplified by approximation 1311 to form an approximate spectrum correction filter 1306, which can be implemented by a smaller calculation volume and storage size. As a simple example of the approximate spectrum correction filter 1306, a filter obtained by limiting the windowing order of the FIR filter expressed by equation (3) to a low order may be used. Alternatively, the frequency characteristic difference from the spectrum correction filter may be defined as a distance on a spectrum domain, and filter coefficients that minimize the difference may be calculated by, e.g., a Newton method or the like to form the approximate correction filter.

In step S25, the approximate spectrum correction filter 1306 formed in step 24 is recorded in the speech synthesis dictionary 502 (in practice, approximate spectrum correction filter coefficients are stored).

In steps S26 to S28, speech waveform data is modified so as to reduce deterioration of sound quality upon applying the approximate spectrum correction filter (or, in other words, to correct an influence of use of the approximate spectrum correction filter) which is formed and recorded in the speech synthesis dictionary 502 in steps S24 and S25, and the modified speech waveform data is registered in the speech synthesis dictionary 502.

In step S26, the spectrum correction filter 1310 and an inverse filter, formed by inverse conversion 1312 of the approximate spectrum correction filter 1306, are synthesized 1313 to form an approximate correction filter 1302.

For example, when the filter given by equation (1) is used as the spectrum correction filter, and a low-order FIR filter given by equation (3) is used as the approximate spectrum correction filter, the approximate correction filter is given by:

$$F_4(z) = \frac{F_1(z)}{F_3(z)} = (1 - \mu z^{-1}) \frac{1 + \sum_{j=1}^{p} \alpha_j (z/\gamma_1)^{-j}}{\left(1 + \sum_{j=1}^{p} \alpha_j (z/\gamma_2)^{-j}\right)\left(1 + \sum_{j=1}^{p'} \beta_j (z)^{-j}\right)} \tag{8}$$

In step S27, the approximate correction filter 1302 is applied to the speech waveform data acquired in step S21 to generate a modified speech waveform 1303. In step S28, the modified speech waveform obtained in step S27 is recorded in the speech synthesis dictionary 502.

The data generation process has been explained. The speech synthesis process will be described below with reference to the flow chart of FIG. 12. In the speech synthesis process, the approximate spectrum correction filter 1306 and modified speech waveform 1303, which have been registered in the speech synthesis dictionary 502 by the above data generation process, are used.

In step S29, a target prosodic value of synthetic speech is acquired. The target prosodic value of synthetic speech may be directly given from a host module like in singing voice synthesis or may be estimated using some means. For example, in case of speech synthesis from text, the target prosodic value of synthetic speech is estimated based on a language analysis result of text.

In step S30, the modified speech waveform recorded in the speech synthesis dictionary 502 is acquired on the basis of the target prosodic value acquired in step S29. In step S31, the approximate spectrum correction filter recorded in the speech synthesis dictionary 502 in step S25 is loaded. Note that the approximate spectrum correction filter to be loaded is the one which corresponds to the modified speech waveform acquired in step S30.

In step S32, a window function 1304 is applied to the modified speech waveform acquired in step S30 to cut micro-segments 1305. As the window function, a Hanning window or the like is used. In step S33, the approximate spectrum correction filter 1306 loaded in step S31 is applied to each of the micro-segments 1305 cut in step S32 to correct the spectrum of each micro-segment 1305. In this way, spectrum-corrected micro-segments 1307 are acquired.

In step S34, the micro-segments 1307 that have undergone spectrum correction in step S33 undergo skipping, repetition, and interval change processes to match the target prosodic value acquired in step S29, and are then re-arranged (1308), thereby changing a prosody. In step S35, the micro-segments re-arranged in step S34 are superposed to obtain synthetic speech (speech segment) 1309. After that, in step S36 synthetic speech is output by concatenating the synthetic speech (speech segments) 1309 obtained in step S35.

In the re-arrangement process of the micro-segments, "skipping" may be executed prior to application of the approximate spectrum correction filter 1306, as shown in FIG. 13. In this way, a wasteful process, i.e., a filter process applied to micro-segments which may be skipped, can be omitted.

Seventh Embodiment

The sixth embodiment has explained the example wherein the order of filter coefficients is reduced by approximation to reduce the calculation volume and storage size. The seventh embodiment will explain a case wherein the storage size is reduced by clustering spectrum correction filters. The seventh embodiment is implemented by three processes, i.e., a clustering process (FIG. 14), data generation process (FIG. 15), and speech synthesis process (FIG. 16). Note that the apparatus arrangement required to implement the processes of this embodiment is the same as that in the sixth embodiment (FIG. 10).

Figure 14:
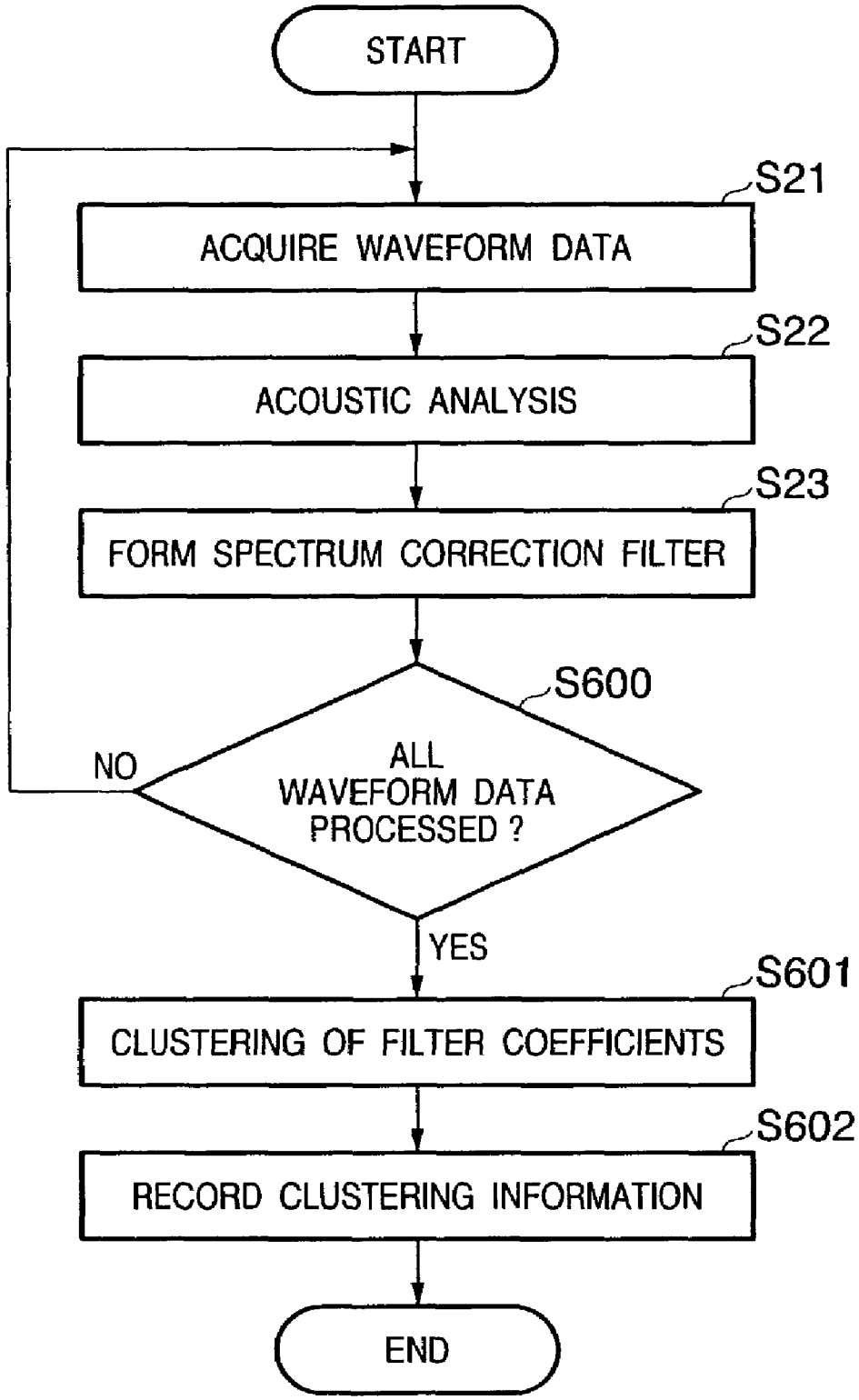
FIG. 14 is a flow chart for explaining a clustering process in a speech output process according to the seventh embodiment.

In the flow chart of FIG. 14, steps S21, S22, and S23 are processes for forming a spectrum correction filter, and are the same as those in the sixth embodiment (FIG. 11). These processes are executed for all waveform data included in the speech synthesis dictionary 502 (step S600).

After spectrum correction filters of all the waveform data are formed, the flow advances to step S601 to cluster the spectrum correction filters obtained in step S23. As clustering, for example, a method called an LBG algorithm or the like can be applied. In step S602, the clustering result (clustering information) in step S601 is recorded in the external storage device 15. More specifically, a correspondence table between representative vectors (filter coefficients) of respective clusters and cluster numbers (classes) is generated and recorded. Based on this representative vector, a spectrum correction filter (representative filter) of the corresponding cluster is formed. In this embodiment, spectrum correction filters are formed in correspondence with respective waveform data registered in the speech synthesis dictionary 502 in step S23, and spectrum correction filter coefficients corresponding to respective waveform data are held in the speech synthesis dictionary 502 as the cluster numbers. That is, as will be described later using FIG. 15, the speech synthesis dictionary 502 of the seventh embodiment registers the waveform data of respective speech waveforms (strictly speaking, modified speech waveform data (to be described later using FIG. 15)), the cluster numbers and representative vectors (representative values of respective coefficients) of spectrum correction filters.

A dictionary generation process (FIG. 15) will be described below. In the dictionary generation process, the spectrum filter formation processes in steps S21 to S23 are the same as those in the sixth embodiment. Unlike in the sixth embodiment, filter coefficients of each spectrum correction filter are vector-quantized and are registered as a cluster number. That is, in step S603 a vector closest to a spectrum correction filter obtained in step S23 is selected from representative vectors of clustering information recorded in step S602. A number (cluster number) corresponding to the representative vector selected in step S603 is recorded in the speech synthesis dictionary 502 in step S604.

Furthermore, a modified speech waveform is generated to suppress deterioration of synthetic speech due to quantization of the filter coefficients of the spectrum correction filter, and is registered in the speech synthesis dictionary. That is, in step S605 a quantization error correction filter used to correct quantization errors is formed. The quantization error correction filter is formed by synthesizing an inverse filter of the filter formed using the representative vector, and a spectrum correction filter of the corresponding speech waveform. For example, when the filter given by equation (1) is used as the spectrum correction filter, the quantization error correction filter is given by:

$$F_5(z) = \frac{\left(1 + \sum_{j=1}^{p} \alpha_j (z/\gamma_1)^{-j}\right)\left(1 + \sum_{j=1}^{p} \alpha'_j (z/\gamma_2)^{-j}\right)}{\left(1 + \sum_{j=1}^{p} \alpha_j (z/\gamma_2)^{-j}\right)\left(1 + \sum_{j=1}^{p} \alpha'_j (z/\gamma_1)^{-j}\right)} \tag{9}$$

where $\alpha'$ is the vector-quantized linear prediction coefficient. When filters of other formats are used, quantization error correction filters can be similarly formed. Waveform data is modified using the quantization error correction filter formed in this way to generate a modified speech waveform (step S27), and the obtained modified speech waveform is registered in the speech synthesis dictionary 502 (step S28). Since each spectrum correction filter is registered using the cluster number and correspondence table (cluster information), the storage size required for the speech synthesis dictionary can be reduced.

In the speech synthesis process, as shown in the flow chart of FIG. 16, step S31 (the step of loading an approximate spectrum correction filter) in the process of the sixth embodiment can be omitted, and step S606 (a process for loading the spectrum correction filter number (cluster number) and step S607 (a process for acquiring a spectrum correction filter based on the loaded cluster number) are added instead.

Figure 15:
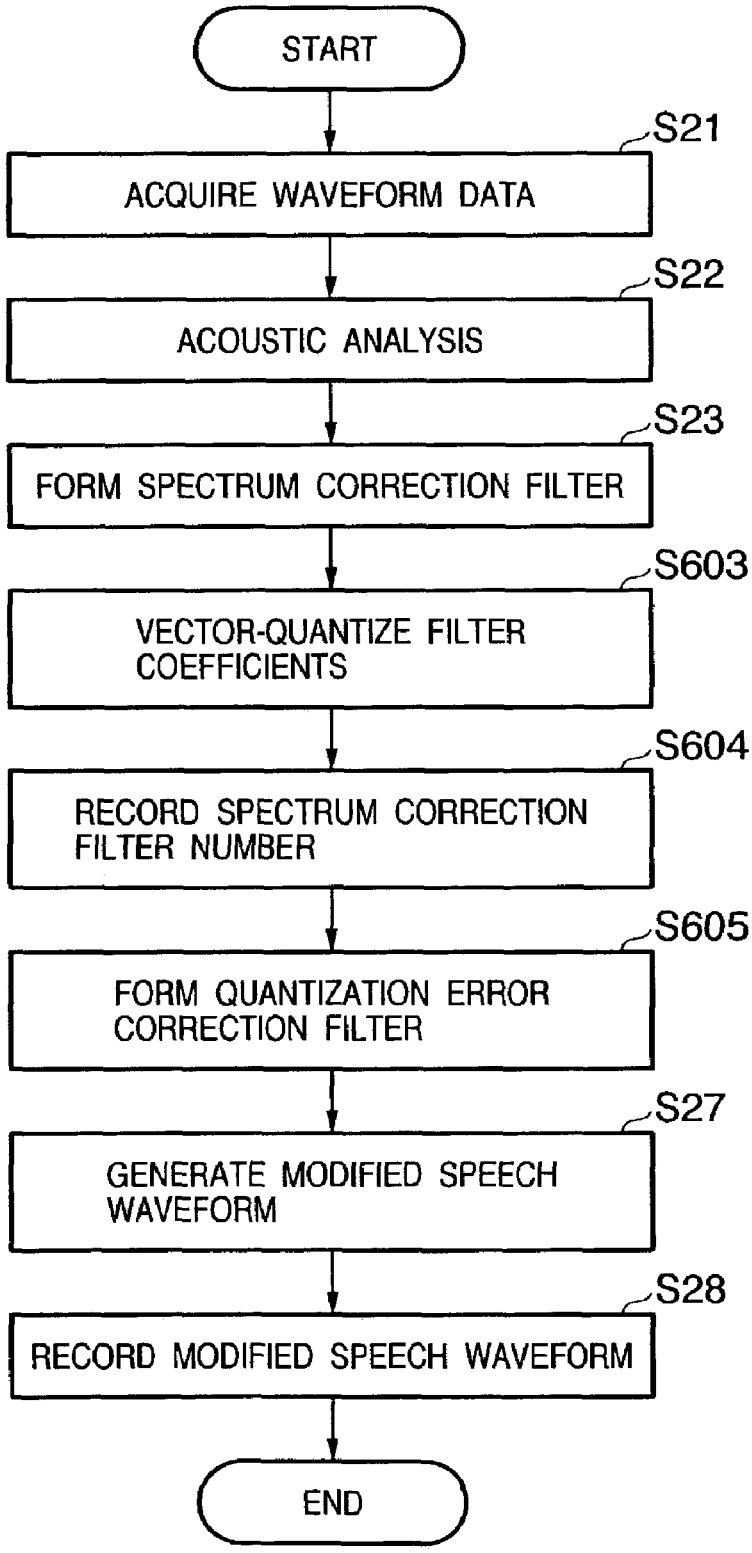
FIG. 15 is a flow chart for explaining a spectrum correction filter registration process in the speech output process according to the seventh embodiment.
Figure 16:
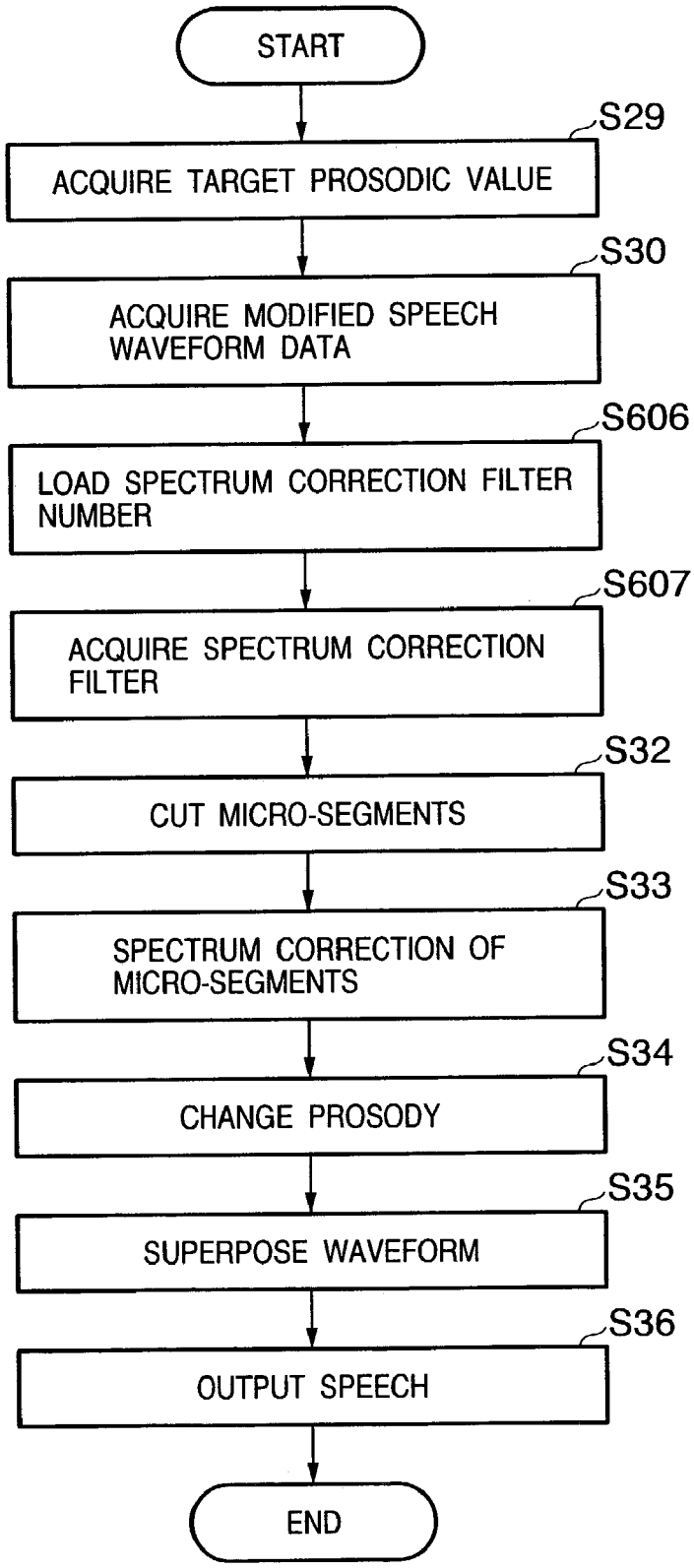
FIG. 16 is a flow chart for explaining a speech synthesis process in the speech output process according to the seventh embodiment.

As in the sixth embodiment, a target prosodic value is acquired (step S29), and the modified speech waveform data registered in step S28 in FIG. 15 is acquired (step S30). In step S606, the spectrum correction filter number recorded in step S604 is loaded. In step S607, a spectrum correction filter corresponding to the spectrum correction filter number is acquired on the basis of the correspondence table recorded in step S602. After that, synthetic speech is output by processes in steps S32 to S36 as in the sixth embodiment. More specifically, micro-segments are cut by applying a window function to the modified speech waveform (step S32). The spectrum correction filter acquired in step S607 is applied to the cut micro-segments to acquire spectrum-corrected micro-segments (step S33). The spectrum-corrected micro-segments are re-arranged in accordance with the target prosodic value (step S34), and the re-arranged micro-segments are superposed to obtain synthetic speech (speech segment) 1309 (step S35).

As described above, even when the spectrum correction filter is quantized by clustering, quantization errors can be corrected using the modified speech waveform modified by the filter given by equation (9). Hence, the storage size can be reduced without deteriorating the sound quality.

In each of the above embodiments, when the sampling frequency of waveform data is high, the waveform data may be split into bands using a band split filter, and each individual band-limited waveform may undergo spectrum correction filtering. In this case, filters are formed for respective bands, a speech waveform itself to be processed undergoes band split, and the processes are executed for respective split waveforms. As a result of band split, the order of the spectrum correction filter can be suppressed, and the calculation volume can be reduced. The same effect is expected by expanding/compressing the frequency axis like mel-cepstrum.

Also, an embodiment that combines the sixth and seventh embodiments is available. In this case, after a spectrum correction filter before approximation is vector-quantized, a filter based on a representative vector may be approximated, or coefficients of an approximate spectrum correction filter may be vector-quantized.

In the seventh embodiment, an acoustic analysis result may be temporarily converted, and a converted vector may be vector-quantized. For example, when linear prediction coefficients are used in acoustic analysis, the linear prediction coefficients are converted into LSP coefficients, and these LSP coefficients are quantized in place of directly vector-quantizing the linear prediction coefficients. Upon forming a spectrum correction filter, linear prediction coefficients obtained by inversely converting the quantized LSP coefficients can be used. In general, since the LSP coefficients have better quantization characteristics than the linear prediction coefficients, more approximate vector quantization can be made.

As described above, according to the sixth and seventh embodiments, the calculation volume and storage size required to execute processes for reducing "blur" of a speech spectrum due to a window function applied to obtain micro-segments can be reduced, and speech synthesis with high sound quality can be realized by limited computer resources.

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus.

In this case, the program code itself read out from the storage medium implements the functions of the above-mentioned embodiments, and the storage medium which stores the program code constitutes the present invention.

As the storage medium for supplying the program code, for example, a flexible disk, hard disk, optical disk, magneto-optical disk, CD-ROM, CD-R, magnetic tape, nonvolatile memory card, ROM, and the like may be used.

The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension board or a function extension unit, which is inserted in or connected to the computer, after the program code read out from the storage medium is written in a memory of the extension board or unit.

As many apparently widely different embodiments of the present invention can be made without departing from the spirit and scope thereof, it is to be understood that the invention is not limited to the specific embodiments thereof except as defined in the claims.

What is claimed is:

1. A speech synthesis method comprising:

an acquisition step of acquiring micro-segments from speech waveform data and a window function;

a correction step of correcting the micro-segments using a spectrum correction filter formed based on the speech waveform data to be processed in the acquisition step, wherein the spectrum correction filter emphasizes the formant of the micro-segments, wherein the spectrum correction comprises a FIR filter whereof the coefficients are acquired by truncating impulse response of a filter having a characteristic represented as $$F_1(z) = (1 - \mu z^{-1})\frac{1 + \sum_{j=1}^{p} \alpha_j (z/\gamma_1)^{-j}}{1 + \sum_{j=1}^{p} \alpha_j (z/\gamma_2)^{-j}}$$

wherein $\alpha_j$ is a coefficient acquired by p-th order linear predictive analysis on the speech waveform and $\mu$, $\gamma_1$, and $\gamma_2$ are appropriately defined coefficients;

a re-arrangement step of re-arranging the micro-segments corrected in the correction step to change prosody upon synthesis by repeating a given micro-segment corrected in the correction step; and a synthesis step of outputting synthetic speech waveform data on the basis of superposed waveform data obtained by superposing the micro-segments re-arranged in the re-arrangement step.

2. The method according to claim 1, further comprising:

a speech synthesis dictionary which registers formation information for a spectrum correction filter in correspondence with each speech waveform data, wherein the correction step includes a step of forming the spectrum correction filter by acquiring formation information corresponding to the speech waveform data to be processed in the acquisition step from the speech synthesis dictionary.

3. A speech synthesis apparatus comprising:

acquisition means for acquiring micro-segments from speech waveform data and a window function;

correction means for correcting the micro-segments using a spectrum correction filter formed based on the speech waveform data to be processed by said acquisition means, wherein the spectrum correction filter emphasizes the formant of the micro-segments, wherein the spectrum correction comprises a FIR filter whereof the coefficients are acquired by truncating impulse response of a filter having a characteristic represented as $$F_1(z) = (1 - \mu z^{-1})\frac{1 + \sum_{j=1}^{p} \alpha_j (z/\gamma_1)^{-j}}{1 + \sum_{j=1}^{p} \alpha_j (z/\gamma_2)^{-j}}$$

wherein $\alpha_j$ s a coefficient acquired by p-th order linear predictive analysis on the speech waveform and $\mu$, $\gamma_1$, and $\gamma_2$ are appropriately defined coefficients;

re-arrangement means for re-arranging the micro-segments corrected by said correction means to change prosody upon synthesis by repeating a given micro-segment corrected by the correction means; and synthesis means for outputting synthetic speech waveform data on the basis of superposed waveform data obtained by superposing the micro-segments re-arranged by said re-arrangement means.

4. A computer readable memory storing a control program for making a computer execute a speech synthesis method of claim 1.

* * * * *